US007250241B2

(12) United States Patent
Ayaki et al.

(10) Patent No.: US 7,250,241 B2
(45) Date of Patent: Jul. 31, 2007

(54) TONER AND PROCESS FOR PRODUCING TONER

(75) Inventors: Yasukazu Ayaki, Yokohama (JP); Koji Abe, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/122,031

(22) Filed: May 5, 2005

(65) Prior Publication Data

US 2005/0208405 A1 Sep. 22, 2005

Related U.S. Application Data

(63) Continuation of application No. PCT/JP04/018438, filed on Dec. 3, 2004.

(30) Foreign Application Priority Data

Dec. 5, 2003 (JP) ..... 2003-406968

(51) Int. Cl.
*G03G 9/08* (2006.01)

(52) U.S. Cl. ..... 430/108.4; 430/108.8; 430/111.4

(58) Field of Classification Search ..... 430/108.4, 430/111.4, 108.8
See application file for complete search history.

(56) References Cited

U.S. PATENT DOCUMENTS

| | | | | |
|---|---|---|---|---|
| 4,797,339 | A | 1/1989 | Maruyama et al. | 430/109 |
| 4,996,127 | A | 2/1991 | Hasegawa et al. | 430/109 |
| 5,741,617 | A * | 4/1998 | Inaba et al. | 430/108.4 |
| 5,795,694 | A | 8/1998 | Uchiyama et al. | 430/110.2 |
| 5,827,632 | A | 10/1998 | Inaba et al. | 430/108.6 |
| 5,998,080 | A | 12/1999 | Ohno et al. | 430/110 |
| 6,475,685 | B2 | 11/2002 | Uchida et al. | 430/99 |
| 6,569,589 | B2 | 5/2003 | Inaba et al. | 430/108.22 |
| 6,582,867 | B2 | 6/2003 | Serizawa et al. | 430/108.4 |
| 6,656,653 | B2 | 12/2003 | Mitsuhashi et al. | 430/108.23 |
| 6,821,702 | B2 | 11/2004 | Fujii et al. | 430/124 |
| 2001/0026899 | A1 * | 10/2001 | Uchida et al. | 430/108.4 |
| 2002/0048010 | A1 | 4/2002 | Inaba et al. | 430/108.22 |
| 2003/0175611 | A1 | 9/2003 | Fujii et al. | 430/124 |

FOREIGN PATENT DOCUMENTS

JP 59-053856 3/1984

(Continued)

OTHER PUBLICATIONS

Diamond, Arthur S & David Weiss (eds.) Handbook of Imaging Materials. New York: Marcel-Dekker, Inc. (Nov. 2001) pp. 145-164, 173-191.*

(Continued)

*Primary Examiner*—Christopher RoDee
(74) *Attorney, Agent, or Firm*—Fitzpatrick, Cella, Harper & Scinto

(57) ABSTRACT

The present invention provides a toner that exhibits excellent low-temperature fixing properties, offset resistance, and has excellent storage stability in a developing machine. The toner has, in a DSC curve obtained by measuring the toner with differential scanning calorimeter, a glass transition temperature (Tg1) measured in a first scan of 50.0 to 70.0° C. and a temperature difference (Tg1–Tg2) between the glass transition temperature (Tg1) measured in the first scan and a glass transition temperature (Tg2) measured in a second scan ranging from 3.0 to 20.0° C.

15 Claims, 3 Drawing Sheets

FOREIGN PATENT DOCUMENTS

| | | |
|---|---|---|
| JP | 59-061842 | 4/1984 |
| JP | 60-252361 | 12/1985 |
| JP | 62-106473 | 5/1987 |
| JP | 63-186253 | 8/1988 |
| JP | 08-050367 | 2/1996 |
| JP | 2001-318484 | 11/2001 |
| JP | 2001-324834 | 11/2001 |
| JP | 2002-072534 | 3/2002 |

OTHER PUBLICATIONS

Patent Abstracts of Japan for JP 2003-215842, published Jul. 2003.
Patent Abstracts of Japan for JP 08-227171, published Sep. 1996.
Patent Abstracts of Japan for JP 09-043896, published Feb. 1997.
Patent Abstracts of Japan for JP 2002-108019, published Apr. 2002.
Patent Abstracts of Japan for JP 2003-140379, published May 2003.

* cited by examiner

TONER AND PROCESS FOR PRODUCING TONER

This application is a continuation of International Application No. PCT/JP2004/018438, filed Dec. 3, 2004, which claims the benefit of Japanese Patent Application No. 2003-406968, filed Dec. 5, 2003.

BACKGROUND OF THE INVENTION

1. Field of the Invention

The present invention relates to a toner used for electrophotography, electrostatic recording, magnetic recording, and toner jet recording, and to a process for producing the toner.

2. Related Background Art

Conventional electrophotography comprises forming an electrostatic image on a photoreceptor by various means, then developing the electrostatic image with a toner to form a toner image on the photoreceptor, transferring the toner image onto a transfer material such as paper if required, and then fixing the toner image onto the transfer material by fixing means such as heat, pressure, heat with pressure, or solvent vapor to obtain an image (see e.g. Society of Electrophotography of Japan (ed.), "Fundamentals and Applications of Electrophotographic Technology" (Denshishashin Gijutsu no Oyo to Kiso), Colona Publishing Co., Ltd., Jun. 15 1988, pp. 46-79).

Various conventional methods for developing with a toner or fixing a toner image have been proposed and employed for respective image-forming processes in a suitable manner. Conventionally, toners used for these purposes have been generally produced by melt mixing a thermoplastic resin with a coloring agent made of a dye and/or a pigment to produce a resin composition with a coloring agent uniformly dispersed, and providing the coloring agent-dispersed resin composition with a desired particle size by a pulverizer or classifier.

This process for producing these toners can produce a quite excellent toner, but have certain limitations. For example, it is necessary that the coloring agent-dispersed resin composition be adequately fragile and can be pulverized by an economically feasible production apparatus. However, when the coloring agent-dispersed resin composition is made fragile, particles formed by actually pulverizing the composition at a high speed tend to have particle sizes within a wide range and, in particular, may comprise relatively large particles, disadvantageously.

Moreover, such a highly fragile material tends to be further pulverized or powdered when used as a toner for development. In this process, it is difficult to uniformly disperse solid microparticles such as a coloring agent into a resin in a good manner. This process may cause increased fogging, a reduced image density, and decreased color mixing or transparence of the toner, depending on the degree of dispersion. In addition, the coloring agent may be exposed on the broken-out section of the toner to cause a change in development characteristics of the toner.

On the other hand, in order to overcome these problems of a toner produced by pulverization, a process for producing a toner by suspension polymerization has been proposed. Suspension polymerization comprises uniformly dissolving or dispersing a polymerizable monomer, a coloring agent, a polymerization initiator and, if required, a crosslinking agent, a charge control agent and other additives to prepare a polymerizable monomer composition, then dispersing the polymerizable monomer composition in an aqueous dispersion medium containing a dispersion stabilizer with a suitable stirrer, and polymerizing the polymerizable monomer to obtain toner particles with a desired particle size (see e.g. Japanese Patent Publication No. 36-10231, Japanese Patent Publication No. 42-10799, and Japanese Patent Publication No. 51-14895).

This process does not comprise a pulverization step, and thus can use a soft material for toner particles, the material not necessarily fragile, does not allow the coloring agent to be exposed on the surface of the toner particles, and provides the particles with uniform triboelectric charging properties. The process can also omit a classification step, and thus exhibits significant cost reduction effects such as energy savings, a reduced production time and an improved step yield.

Methods for fixing a toner image such as heat pressing by a heat roller (hereinafter referred to as heat roller fixing) and heat fixing while causing a heating body to adhere to a sheet to be fixed via a fixing film (hereinafter referred to as film fixing) have been developed.

Heat roller fixing or film fixing comprises bringing the surface of a heat roller or fixing film into contact with a toner image on a sheet to be fixed, under pressure by a pressing member in contact with the roller or film, to cause the roller or film to pass the sheet, thereby fixing the toner image. This fixation method allows the surface of a heat roller or fixing film to be brought into contact with a toner image of a sheet to be fixed, and therefore exhibits extremely high thermal efficiency in melting a toner image onto the sheet and enables rapid and good fixing.

Electrophotographic apparatuses in recent years have been demanded variously to provide high image quality, to be downsized and lightened, to be produced at a high speed with high productivity, to save energy, to be highly reliable, to be inexpensive, and to be maintenance-free. In particular, important technical objectives for a fixing step are to develop systems and materials that can achieve further high-speed production, energy savings, and high reliability. However, in order to achieve these objectives with heat roller fixing or film fixing, it is essential to improve fixing properties of a toner as a material considerably, and it is necessary to improve properties that can make a toner fixed onto a sheet to be fixed sufficiently at a lower temperature (hereinafter referred to as low-temperature fixing properties) and to improve properties that can prevent an offset as a phenomenon in which the toner contamination attached onto the surface of a heat roller or film contaminates the next sheet to be fixed (hereinafter referred to as offset resistance), in particular.

Toners used for fixing with heat and pressure, which contain a wax with high affinity for a binder resin, exhibit good offset resistance and low-temperature fixing properties under specific fixing conditions (see e.g. Japanese Patent Application Laid-Open No. H5-50367 and Japanese Patent Application Laid-Open No. 2001-318484). Toners containing two or more waxes with different affinities for a binder resin can exhibit good low-temperature fixing properties and improved offset resistance under specific fixing conditions (see e.g. Japanese Patent Application Laid-Open No. 60-252361, Japanese Patent Application Laid-Open No. H8-50367, Japanese Patent Application Laid-Open No. 2001-324834, and Japanese Patent Application Laid-Open No. 2002-72534). However, since these toners have a lower glass transition temperature as the wax is compatible with a binder resin, the toners tend to have impaired storage stability, flowability, and charging properties, and easily cause a remarkable density reduction and image defects particularly when continuously printed. Therefore, a toner with satisfactory storage stability and development stability and enhanced low-temperature fixing properties has been desired.

An object of the present invention is to provide a toner that can solve the above-described problems.

SUMMARY OF THE INVENTION

Specifically, an object of the present invention is to provide a toner that exhibits excellent low-temperature fixing properties and offset resistance and exhibit, without impairing these properties, excellent storage stability, flowability, charging properties, and development durability in a developing machine.

Another object of the present invention is to provide a toner that exhibits excellent low-temperature fixing properties and offset resistance and is free from toner contamination or carrier contamination of the surface of a toner carrying member or photoreceptor in a developing machine due to endurance.

Still another object of the present invention is to provide a process that can produce the above-described toner in a suitable manner.

The present invention relates to a toner having, in a DSC curve obtained by measuring the toner with differential scanning calorimeter, a glass transition temperature (Tg1) measured in a first scan of 50.0 to 70.0° C. and a temperature difference (Tg1−Tg2) between the glass transition temperature (Tg1) measured in the first scan and a glass transition temperature (Tg2) measured in a second scan of 3.0 to 20.0° C.

The present invention also relates to a process for producing a toner, comprising at least a granulation step comprising dispersing a polymerizable monomer composition comprising at least a coloring agent, a wax, and a polymerizable monomer for synthesizing a binder resin in an aqueous dispersion medium, and granulating the composition to produce particles of the polymerizable monomer composition; a polymerization step comprising heating the particles of the polymerizable monomer composition to 70.0 to 95.0° C. in the aqueous dispersion medium, and polymerizing the polymerizable monomer in the polymerizable monomer composition to produce toner particles; and a cooling step comprising cooling the toner particles to 45.0° C. or lower from 70.0 to 95.0° C. at a cooling rate of 0.01° C./min to 2.00° C./min, the toner produced by the process for producing a toner having, in a DSC curve obtained by measuring the toner with differential scanning calorimeter, a glass transition temperature (Tg1) measured in a first scan of 50.0 to 70.0° C. and a temperature difference (Tg1−Tg2) between the glass transition temperature (Tg1) measured in the first scan and a glass transition temperature (Tg2) measured in a second scan of 3.0 to 20.0° C.

The toner of the present invention has low-temperature fixing properties and offset resistance in combination, exhibits excellent storage stability and development durability, does not cause contamination in a developing machine over a long period of time, and can form an image with high image quality.

The process for producing a toner of the present invention can produce the above-described toner in a suitable manner.

DESCRIPTION OF THE PREFERRED EMBODIMENTS

Figure 1:
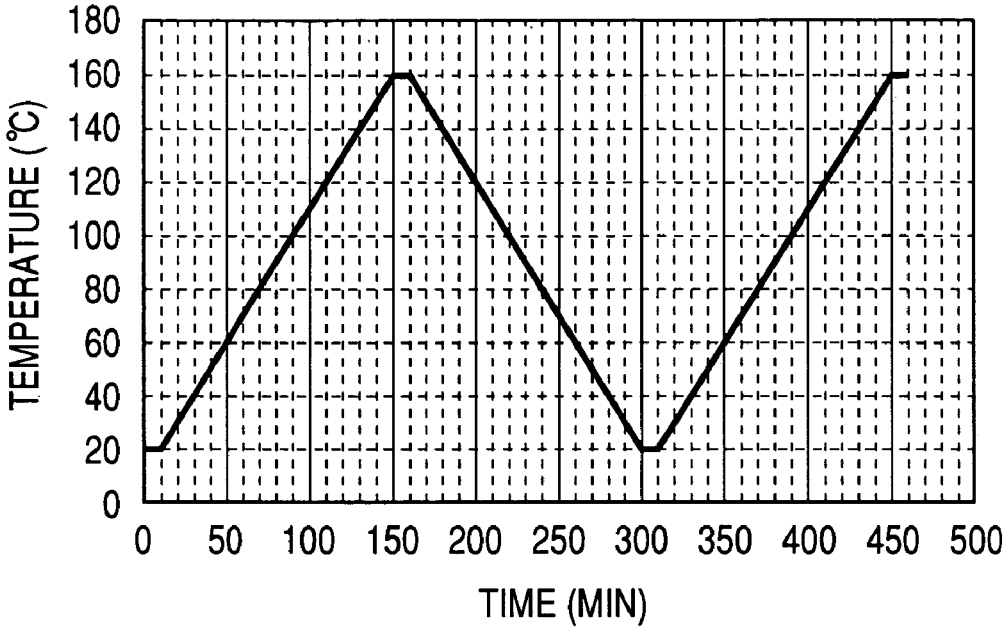
FIG. 1 is a graph showing a temperature rising mode of DSC measuring equipment.

The inventors have found that, according to the present invention, the glass transition temperature (Tg1) of a toner measured in a first scan by a differential scanning calorimeter (DSC) may differ from the glass transition temperature (Tg2) of a toner measured in a first scan by DSC and, when the glass transition temperature (Tg1) measured in the first scan is 50.0 to 70.0° C., and the difference between the glass transition temperature (Tg1) measured in the first scan and the glass transition temperature (Tg2) measured in the second scan is 3.0 to 20.0° C., the toner can have improved low-temperature fixing properties, offset resistance and development characteristics.

According to the present invention, toner properties of a toner before a fixing step such as storage stability and development stability depend on the glass transition temperature (Tg1) of the toner determined by the measuring method of the present invention, and low-temperature fixing properties in the fixing step depend on the glass transition temperature (Tg2) of the toner. The toner of the present invention contains a plastic crystalline resin such as a wax, which is largely in a crystalline state, and has a glass transition temperature of Tg1, before the fixing step. However, when the toner on a transfer material is brought into contact with a fixing apparatus and heated in the fixing step, a part of the crystalline resin in the toner is compatible with a binder resin to reduce the apparent glass transition temperature of the toner, whereby the toner has a glass transition temperature of Tg2. Accordingly, the toner can exhibit low-temperature fixing properties that cannot have been achieved in a prior art, without reducing storage stability and development stability.

In order to achieve the above-described relation between Tg1 and Tg2, the toner preferably contains a resin component of a molecular weight of 2,000 to 5,000 in an amount of 1.0 to 40.0% by weight based on the total weight of the toner. By setting the content of the resin component with a low molecular weight such as a molecular weight of 2,000 to 5,000 is in the above range, a toner can be produced so that crystallization of a crystalline resin such as a wax is promoted to allow the most part of the crystalline resin contained in the toner to be in a crystalline state, but, when the toner is heated to a high temperature such as a fixing temperature, the crystalline resin is compatible with a binder resin.

The degrees of crystallization of the crystalline resin in the toner production step and compatibility of the crystalline resin with a binder resin in the fixing step are associated with the content in the toner of the resin component of a molecular weight of 2,000 to 5,000.

As the crystalline resin has a larger part of a folded structure or overlapped structure with a regular molecular chain in a solid state, the crystalline resin has a larger degree of crystallization. If the binder resin contains too much an amount of the low molecular weight resin component of a molecular weight of 2,000 to 5,000, the crystalline resin is easily mixed with the low molecular weight component, and formation of a regular folded structure or overlapped structure is easily inhibited when the crystalline resin becomes a solid. Thus, as the amount of the low molecular weight component is smaller, the degree of crystallization tends to be larger.

However, if the content of the resin component of a molecular weight of 2,000 to 5,000 is less than 1.0% by weight, crystal growth of the crystalline resin in the toner production step is promoted, but the amount of the crystalline resin compatible with the binder resin decreases in the fixing step. Thus, the plasticizing effect exhibited by making the crystalline resin compatible with the binder resin may not be obtained, thereby decreasing fixing properties of the toner.

In addition, since a large amount of the crystalline resin exists in the toner in a solid state, a part of the resin is easily exposed on the surface of the toner or isolated, and the toner may have decreased development stability.

In the meantime, if the content of the resin component of a molecular weight of 2,000 to 5,000 is more than 40.0% by weight, the amount of the crystalline resin compatible with the binder resin in the toner production step increases, and the difference between Tg1 and Tg2 tends to be less than 3° C. In this case, the toner exhibits excellent low-temperature fixing properties, but tends to exhibit decreased storage stability and development stability.

In the present invention, the resin component of a molecular weight of 2,000 to 5,000 is contained in the toner in an amount of preferably 1.0 to 40.0% by weight, and more preferably 1.5 to 20.0% by weight, based on the total weight of the toner.

In the present invention, the temperature difference (Tg1−Tg2) between Tg1 and Tg2 is 3.0 to 20.0° C., preferably 4.0 to 15.0° C., and more preferably 5.0 to 12.0° C. If the temperature difference (Tg1−Tg2) between Tg1 and Tg2 is less than 3.0° C., storage stability and development stability decrease when low-temperature fixing properties are improved, and sufficient low-temperature fixing properties cannot be obtained when storage stability and development stability are improved. In the meantime, if the temperature difference (Tg1−Tg2) between Tg1 and Tg2 is more than 20.0° C., low-temperature fixing properties and storage stability may be good, but the toner exhibits a melt viscosity in the fixing step and seeps into a transfer material such as plain paper, and a sufficient image density cannot be obtained. These values (Tg1−Tg2) change depending upon the composition and molecular weight of the binder resin contained in the toner, the composition and the amount added of the crystalline resin, the process of producing the toner, etc.

In the present invention, Tg1 is 50.0 to 70.0° C., preferably 50.0 to 65.0° C., and more preferably 53.0 to 62.0° C.

When the Tg1 value is more than 70.0° C., the amount of the crystalline resin in the toner compatible with the binder resin during production of the toner is small, and the amount of the resin compatible with the binder resin during fixing also tends to be small. Thus, when the toner exhibits sufficient storage stability, the toner cannot be provided with good low-temperature fixing properties. On the other hand, when Tg1 is less than 50.0° C., the amount of the crystalline resin compatible with the binder resin during production of the toner is large, and the amount of the resin compatible with the binder resin during fixing is also large. Thus, good low-temperature fixing properties can be obtained, but sufficient storage stability and development stability cannot be obtained.

In the present invention, Tg2 is preferably 45.0 to 55.0° C.

In the present invention, the above-described Tg1 and Tg2 are measured using a differential scanning calorimeter (DSC). As DSC measuring equipment, M-DSC manufactured by TA Instruments Inc. is used in the present invention. In the measuring method, 6 mg of a toner as a sample to be measured is weighed on an aluminum pan, and an empty aluminum pan is used as a reference pan to measure the toner in a nitrogen atmosphere at a modulation amplitude of 1.0° C. at a frequency of 1/min. After maintaining at 10° C. for one minute, the toner is scanned from 10° C. to 160° C. at a rate of temperature rise of 1° C./min to obtain a reversing heat flow curve as a DSC curve, and Tg1 is determined from the DSC curve by a midpoint method. After maintaining at 160° C. for 10 minutes, the toner is cooled from 160° C. to 10° C. at a cooling rate of 2° C./min and maintained at 10° C. for 10 minutes. Then, Tg2 is determined by a midpoint method from the reversing heat flow curve obtained by scanning the toner from 10° C. to 160° C. at a rate of temperature rise of 1° C./min. FIG. 1 shows a graph of the temperature rising mode of DSC measuring equipment at this time. The glass transition temperature determined by the midpoint method is a glass transition temperature as a point of intersection of the median line between the base line before an endothermic peak and the base line after the endothermic peak with the rising curve in a DSC curve when the temperature rises (see FIGS. 2 and 3).

The melting point of the toner measured is a maximum value of the melting peak in a reversing heat flow curve obtained in the same manner as above. The onset value of the melting point is a temperature at a point of intersection of the tangent drawn at the maximum inclination point of the rising part of the melting peak with the extrapolated base line before the peak, and the offset value of the melting point is a temperature at a point of intersection of the tangent drawn at the maximum inclination point before the end of the melting peak with the extrapolated base line after the peak.

The endothermic quantity is determined from the area surrounded by the straight line, which connects the point at which the peak rises from the extrapolated base line before the melting peak with the point at which the extrapolated base line after the end of the melting peak is in contact with the peak, and the melting peak in the reversing heat flow curve obtained in the above measurement.

In the present invention, the molecular weight of the resin component contained in the toner and the content of the resin component of a molecular weight of 2,000 to 5,000 in the toner are measured using gel permeation chromatography (GPC) equipment (manufactured by Tosoh Corp.).

GPC equipment will be described below.

A column is stabilized in a heat chamber at 40° C. THF (tetrahydrofuran) as a solvent is caused to flow through the column at this temperature at a flow rate of 1 ml/min to inject and measure 100 μl of a THF sample solution. To measure the molecular weight of the sample, the molecular weight distribution possessed by the sample is calculated from the relation between the logarithmic value of a calibration curve prepared with several monodisperse polystyrene standard samples and the number of counts. As the standard polystyrene samples for preparing a calibration curve, at least about ten standard polystyrene samples with a molecular weight of $10^2$ to $10^7$ manufactured by Tosoh Corp. or Showa Denko K.K. are suitably used, for example. An RI (refraction index) detector is used as a detector. As the column, it is preferable to use multiple commercially available polystyrene gel columns in combination. Examples include combinations of shodex GPC KF-801, 802, 803, 804, 805, 806, 807, and 800P (manufactured by Showa Denko K.K.) and combinations of TSK gel G1000H (HXL), G2000H (HXL), G3000H (HXL), G4000H (HXL), G5000H (HXL), G6000H (HXL), G7000H (HXL), and TSK guard column.

The content of the resin component of a molecular weight of 2,000 to 5,000 is determined from the elution curve obtained in the above measurement.

A sample used for the GPC equipment is prepared as follows.

A toner sample is added to and sufficiently mixed with tetrahydrofuran (THF), and the mixture is allowed to stand for 12 to 18 hours. Then, the mixture is passed through a sample treatment filter (pore size: 0.45 to 0.5 mm; for which Myshori Disc H-25-5 manufactured by Tosoh Corp. or Ekicrodisc 25CR manufactured by German Science Japan, Ltd. is available, for example) to prepare a GPC sample. The concentration of the sample is adjusted so that the concentration of the resin component is 0.04 to 0.08% by weight.

As the binder resin used in the present invention, any of known binder resins can be used. Examples include styrene copolymers such as a styrene-acrylic ester resin and a styrene-methacrylic ester resin and polyester resins.

The toner of the present invention preferably contains a tetrahydrofuran (THF)-insoluble matter in an amount of 5 to 90% by weight based on the total weight of the toner. The amount is more preferably 5 to 70% by weight, and still more preferably 5 to 65% by weight. This is because storage stability, development stability and low-temperature fixing properties are provided in a more balanced manner.

The THF-insoluble matter of the toner indicates the ratio by weight of an ultrahigh molecular weight polymer component (substantially a crosslinked polymer) rendered insoluble in a THF solvent. The THF-insoluble matter of the toner is defined as a value measured as follows.

1 g of the toner is weighed (W1g), fed into a cylinder of filter paper (e.g. No. 86R manufactured by Toyo Roshi Kaisha, Ltd.) and subjected to a Sohxlet extractor to extract the soluble component with 200 ml of THF as a solvent for six hours. The soluble component extracted with the THF solvent is evaporated and then vacuum dried at 100° C. for several hours to weigh the THF-soluble matter (W2g). The THF-insoluble matter of the toner is calculated from the following formula.

$$THF\text{-insoluble matter of toner (\% by weight)}=\{(W1-W2)/W1\}\times 100$$

The toner of the present invention preferably has the above-described THF-soluble matter with a number average molecular weight (Mn) of 3,000 to 100,000, a weight average molecular weight (Mw) of 10,000 to 1,000,000, and a ratio of Mw to Mn (Mw/Mn) of 2.00 to 100.00. This is because storage stability, development stability, and low-temperature fixing properties are provided in a more balanced manner.

The toner of the present invention preferably has a melting point (Tm1) of 55.0 to 70.0° C. in a DSC curve measured in a first scan. The toner of the present invention preferably has a ratio (Q1/Q2) of an endothermic quantity Q1 measured in a first scan to an endothermic quantity Q2 determined in a second scan of 2.00 to 50.00. The toner with a melting point (Tm1) of 55.0 to 70.0° C. has a crystalline resin such as a wax that can be crystallized during production of the toner and be compatible with the binder resin in a well-balanced manner, and has a value of Q1/Q2 of 2.00 to 50.00. The toner with a Q1/Q2 value within the above range exhibits better storage stability and low-temperature fixing properties. If the Q1/Q2 value is more than 50.00, the toner may have a too small melting viscosity, making the fixing region on the high temperature side small. If the Q1/Q2 value is less than 2, the fixing region on the low temperature side may be small.

The toner of the present invention preferably has a melting point (Tm2) of 71.0 to 150.0° C. in a DSC curve measured in the second scan. The toner of the present invention preferably has a ratio (Q3/Q4) of the endothermic quantity Q3 determined in the first scan to the endothermic quantity Q4 measured in the second scan of 0.80 to 1.20. This is because the toner with a Q3/Q4 value within the above range provides a better fixing region on the high temperature side. Further, the above-described Q4 is preferably in the range of 1.5 to 20.0 J/g. If Q4 exceeds 20.0 J/g, the toner may fail to be sufficiently transferred from a fixing apparatus, making the fixing region on the low temperature side small. If Q4 is less than 1.5 J/g, the fixing region on the high temperature side may be small.

The toner of the present invention preferably has a transformation initiation temperature (Tf1) of 45.0 to 60.0° C., a transformation termination temperature (Tf2) of 55.0 to 75.0° C., and a transformation coefficient (Tfr) of 0.3 to 0.7. The transformation initiation temperature (Tf1), transformation termination temperature (Tf2), and transformation coefficient (Tfr) in the present invention are indexes showing thermodynamical characteristics of the toner, specifically, values measured by a method as shown below.

0.2 g of the toner is weighed on a pressure forming machine, and is pressure formed at a load of 200 kgf for two minutes in a normal temperature and pressure environment to prepare a columnar sample with a diameter of about 8 mm and a height of 1 to 4 mm. The columnar sample is placed on the center of a cylindrical container with the bottom polished having an inner diameter of about 10 mm and a inner wall height of 20 mm or more, and a pressure jig having an outer diameter of about 9.9 mm and a thickness of 10 mm or more is further brought into contact with the sample. After maintaining the sample at 35° C. for five minutes, a load of 10 kgf is applied to the pressure jig, and the columnar sample is heated to 120° C. at a rate of temperature rise of 1° C./min to measure the displacement magnitude of the pressure jig in contact with the sample. Based on the resulting chart, the temperature at which the sample starts transforming (° C.) is defined as the transformation initiation temperature (Tf1), and the temperature at which the transformation is terminated (° C.) is defined as the transformation termination temperature (Tf2). The temperature at the point of intersection (onset point) of a straight line, in which the base line on the low temperature side is extended to the high temperature side, with the tangent, drawn at the point where the gradient of the curve in the stepwise varying part of the transformation is maximum, is defined as Tff1, and the height of the pressure jig at this time is defined as Hf1. The temperature at the point of intersection (offset point) of a straight line, in which the base line on the high temperature side is extended to the low temperature side, with the tangent, drawn at the point where the gradient of the curve in the stepwise varying part of the transformation is maximum, is defined as Tff2, and the height of the pressure jig at this time is defined as Hf2. The value determined from the following formula is defined as the transformation coefficient (Tfr). The above measurement can be carried out, for example, by using a SUS-316 plate not holed instead of a die on which the sample is to be placed in a flow tester (CFT-500D, manufactured by Shimadzu Corp.). A measurement chart example is shown in Table 4.

$$Tfr=(Hf2-Hf1)/(Tf2-Tf1)$$

According to the present invention, the transformation initiation temperature (Tf1) obtained from the above measurement correlates with blocking resistance, low-temperature fixing properties, and development stability, the transformation termination temperature (Tf2) correlates with high-temperature offset resistance, and the transformation coefficient (Tfr) correlates with gloss properties.

Specifically, when the transformation initiation temperature (Tf1) is lower than 45.0° C., low-temperature fixing properties are improved, but blocking occurs in a developing machine and fogging and image defects also occur. On the other hand, if Tf1 exceeds 60.0° C., development stability is improved, but sufficient low-temperature fixing properties cannot be obtained.

If the transformation termination temperature (Tf2) is lower than 55.0° C., a high-temperature offset occurs easily, making the fixing region remarkably small. If Tf2 exceeds 75.0° C., high-temperature offset resistance is improved, but a low temperature offset occurs easily, and low-temperature fixing properties decrease.

If the transformation coefficient (Tfr) is less than 0.3, sufficient gloss cannot be obtained. If Tfr exceeds 0.7, too much an amount of the toner seeps into transfer paper during fixing, thereby reducing gloss.

The above property values of the toner can be achieved by a balance between the glass transition temperature (Tg) of the binder resin and the amount of the crystalline resin, which plasticizes the binder resin such as a wax, compatible with the binder resin. For example, a toner with a low Tg determined by DSC tends to have small Tf1 and Tf2 values. A toner in which a large amount of the crystalline resin such as a wax is compatible with the binder resin tends to have a Tfr value of more than 0.7. A toner in which the amount of the crystalline resin compatible is small resin tends to have a Tfr value of less than 0.3.

The amount of the crystalline resin compatible can be controlled by the composition and molecular weight distribution of the binder resin, the composition and amount added of the plasticizing component, the process for producing the toner, and the like. Generally, as Tg of the binder resin is smaller, the amount of the crystalline resin compatible tends to be larger and, as the molecular weight is smaller, the amount of the resin compatible tends to be larger.

In the composition of the crystalline resin, as the melting point is smaller, the amount of the crystalline resin compatible tends to be larger. As the number of carbon atoms of an alkyl group contained in the wax is smaller, the amount of the crystalline resin compatible tends to be larger. As the temperature width between the onset value of the melting point and the offset value of the melting point is larger, or as the difference between the melting point and the onset value is larger, the amount of the resin compatible tends to be larger. In the meanwhile, as the number of carbon atoms of an alkyl group contained in the wax is larger, crystallinity tends to be larger. As the difference between the melting point and the offset value is larger, crystallinity tends to be larger. Among kinds of waxes, polar waxes such as an ester wax tends to be compatible with the binder resin in a large amount, and low-polar waxes such as a paraffin wax tends to be compatible with the binder resin in a small amount. Further, since these waxes exhibit an increased affinity with the binder resin at a high temperature, if the toner is produced by quenching from a high temperature state rather than cooling slowly, the waxes tend to be compatible with the binder resin in a larger amount.

Examples of the crystalline resin such as a wax used in the toner of the present invention include paraffin waxes, polyolefin waxes, microcrystalline waxes, polymethylene waxes such as a Fischer-Tropsch wax, amide waxes, higher fatty acids, long-chain alcohols, ester waxes, and ketone waxes, and their derivatives such as graft compounds and block compounds. These are preferably waxes in which a low molecular weight component contained in the waxes is removed and which have a sharp maximum endothermic peak of a DSC curve.

Crystalline resins preferably used among these include waxes such as $C_{18}$ to $C_{42}$ linear alkyl alcohols, fatty acids, fatty acid amides, fatty acid esters, or montan derivatives. In particular, in order to promote crystallization during production of the toner and make the wax compatible with the binder resin during fixing in a balanced manner, ester waxes having a $C_{18}$ to $C_{42}$ ester compound are preferable, and ester waxes having a $C_{30}$ to $C_{42}$ ester compound are more preferable. Moreover, the ester waxes used in the present invention preferably have a fatty acid ester compound having a $C_{10}$ to $C_{21}$ alkyl group. Further, it is also preferable to remove impurities such as liquid fatty acid from these waxes.

Examples of the ester waxes include a compound represented by the following formula (I):

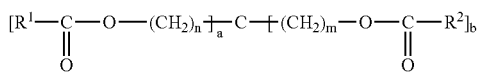

(I)

wherein a and b are an integer of 0 to 4, a+b is 4, $R^1$ and $R^2$ are a $C_1$ to $C_{40}$ organic group, at least one of $R^1$ and $R^2$ has 10 to 21 carbon atoms, m and n are an integer of 0 to 20, and m and n do not concurrently represent 0;

a compound represented by the following formula (II):

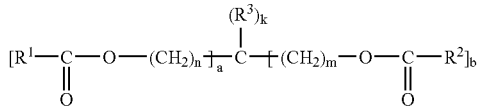

(II)

wherein a and b are an integer of 0 to 3, a+b is 1 to 3, $R^1$ and $R^2$ are a $C_1$ to $C_{40}$ organic group, at least one of $R^1$ and $R^2$ is a $C_{10}$ to $C_{20}$ alkyl group, $R^3$ is a hydrogen atom or a $C_1$ to $C_{20}$ organic group, k is an integer of 1 to 3, a+b+k is 4, m and n are an integer of 0 to 20, and m and n do not concurrently represent 0;

a compound represented by the following formula (III):

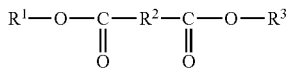

(III)

wherein $R^1$ and $R^3$ are a $C_1$ to $C_{40}$ organic group, at least one of $R^1$ and $R^3$ is a $C_{10}$ to $C_{21}$ alkyl group, and $R_2$ represents a $C_1$ to $C_{20}$ organic group;

a compound represented by the following formula (IV):

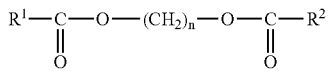

(IV)

wherein $R^1$ and $R^2$ are a $C_1$ to $C_{40}$ organic group, at least one of $R^1$ and $R^3$ is a $C_{10}$ to $C_{21}$ alkyl group, and n represents an integer of 1 to 20;

a compound represented by the following formula (V):

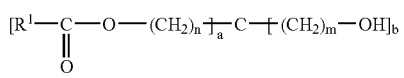

(V)

wherein a is an integer of 0 to 3, b is an integer of 1 to 4, a+b is 4, $R^1$ is a $C_1$ to $C_{21}$ alkyl group, m and n are an integer of 0 to 20, and m and n do not concurrently represent 0; and a compound represented by the following formula (VI):

$$R^1—COO—R^2 \quad (VI)$$

wherein $R^1$ and $R^2$ are a $C_1$ to $C_{39}$ organic group, and $R^1$ and $R^2$ have 17 to 41 carbon atoms in total.

Further, examples of the crystalline resin preferably used in a combination with the above ester waxes, paraffin waxes, polyolefin waxes, microcrystalline waxes, and polymethylene waxes such as a Fischer-Tropsch wax. The polymethylene waxes include low molecular weight polymethylene waxes obtained from an alkylene by radical polymerization at a high pressure or polymerization using a Ziegler catalyst or another catalyst at a low pressure; polymethylene waxes obtained by decomposing a high molecular weight alkylene polymer with heat; polymethylene waxes obtained by separating and purifying a low molecular weight alkylene polymer as a by-product when polymerizing an alkylene; and polymethylene waxes obtained by extracting and fractionating a specific component from a distillation residue of a hydrocarbon polymer, obtained from a synthetic gas composed of carbon monoxide and hydrogen by an Arge method, or from a synthetic hydrocarbon obtained by hydrogenating the distillation residue. An antioxidant may be added to these waxes.

The crystalline resin such as a wax used in the present invention has a melting point (temperature corresponding to the maximum endothermic peak of a DSC curve at a temperature of 20.0 to 200.0° C.) of preferably 40.0 to 150.0° C., more preferably 55.0 to 150.0° C., and still more preferably 55.0° C. to 110.0° C.

In the present invention, in terms of crystallinity during production of the toner and compatibility with the binder resin, an ester wax is preferably used as the crystalline resin. The wax has a difference between the onset value of the melting point and the offset value of the melting point of preferably within 20.0° C., and more preferably within 10.0° C. The value of difference between the onset value of the melting point and the offset value of the melting point affects compatibility of the wax with the binder resin. If the value exceeds 20.0° C., development characteristics may decrease.

The wax has a difference between the melting point and the onset value of preferably within 10.0° C., and more preferably within 5.0° C. The wax has a difference between the melting point and the offset value of preferably within 10.0° C., and more preferably within 5.0° C. The value of difference between the melting point and the onset value and the value of difference between the melting point and the offset value affect compatibility of the wax with the binder resin. If each value exceeds 10° C., development characteristics may decrease.

The wax is preferably a solid wax which is solid at room temperature. As the solid wax, a combination of a low-melting wax having a melting point of 50.0 to 70.0° C. with a high-melting wax having a melting point of 71.0 to 150.0° C. is preferably used. The low-melting wax has a difference between the onset value of the melting point and the offset value of the melting point of preferably within 20.0° C., and more preferably within 10.0° C. The high-melting wax has a melting point of preferably 71.0 to 150.0° C., and more preferably 71.0 to 110.0° C. When the high-melting wax is used in a combination with the low-melting wax, the high-melting wax has a difference between the onset value of the melting point and the offset value of the melting point of preferably 5.0 to 80.0° C., and more preferably 8.0 to 50.0° C.

Further, the ester wax is preferably an ester wax which has two or more ester compounds and contains an ester compound with an identical structure in an amount of 50 to 95% by weight based on the total weight of the ester wax. Such a content value as above affects the onset value and the offset value in the melting peak of the wax, and affects compatibility of the wax with the binder resin. The content of the ester compound having an identical structure can be measured by gas chromatography (GC) as described below.

The content of the ester compound having an identical structure is measured by GC using GC-17A (manufactured by Shimadzu Corp.). 1 μl of a solution of a sample in toluene at a concentration of 1% by weight is injected into GC equipment with an on-column injector. As the column, Ultra ALLOY-1 (HT) with a diameter of 0.5 mm and a length of 10 m is used. The column is first heated from 40° C. to 200° C. at a speed of temperature rise of 40° C./min, then heated to 350° C. at 15° C./min, and subsequently heated to 450° C. at 7° C./min. As the carrier gas, a He gas is caused to flow at a pressure of 50 kPa. The type of the compound is identified by injecting an alkane having a known number of carbon atoms separately for comparing the same efflux times with each other, or by introducing a gaseous component into a weight spectrograph, to identify the structure. The content of the ester compound is calculated by determining the ratio of the peak area to the total peak area of the chromatogram.

In the present invention, the content of the wax is preferably 1 to 40 parts by weight (and more preferably 2 to 20 parts by weight) based on 100 parts by weight of the binder resin. When the toner is produced by polymerization, the wax is added to a polymerizable monomer in an amount of preferably 1 to 40 parts by weight (and more preferably 2 to 20 parts by weight) of 100 parts by weight of the monomer. When the toner is produced by melt kneading and pulverization, the wax is contained in the toner in an amount of preferably 1 to 10 parts by weight (and more preferably 2 to 8 parts by weight) of 100 parts by weight of the toner.

The wax used in the present invention has a value of solubility parameter (SP) of 7.6 to 10.5. The wax with an SP value of less than 7.6 is poorly compatible with the polymerizable monomer or binder resin used. As a result, the wax is difficult to be well dispersed in the binder resin, is easily attached to a development sleeve when many pieces are copied or printed, and easily causes a change in the charge quantity. Further, the wax easily causes ground fogging and a variation in the concentration of the toner when feeding the toner. When the wax with an SP value of more than 10.5, the toner components tend to block with each other when the toner is stored for a long time. Further, since the wax is too much compatible with the binder resin, it is difficult to form a sufficient release layer between a fixing member and the toner when fixing, whereby an offset phenomenon easily occurs.

The value of solubility parameter (SP) can be calculated by a method by Fedors utilizing additivity of an atomic group (Polym. Eng. Sci., 14(2) 147 (1974)).

The wax used in the present invention has a melt viscosity at 135° C. of preferably 1 to 300 cPs, and more preferably 3 to 50 cPs. In the case where the wax has a melt viscosity of lower than 1 cPs, when a development sleeve is thin-layer coated with a toner layer with a coating blade by nonmagnetic one-component development, the sleeve tends to be contaminated by a mechanical shear force. In two-component development, when an electrostatic image is developed using carrier particles and the toner, the toner is easily damaged due to a shear force between the toner and the carrier particles, an external additive is easily buried, and the toner is easily crushed. In the case where the wax has a melt viscosity of more than 300 cPs, when the toner is produced by polymerization, the polymerizable monomer composition has a high viscosity, making it difficult to obtain a toner having a sharp particle size distribution and a small particle size.

The melt viscosity of the toner can be measured using a cone plate rotor (PK-1) in VP-500 manufactured by HAAKE.

The wax has a degree of penetration of 14 or less, more preferably 4 or less, and still more preferably 3 or less. If the degree of penetration exceeds 14, filming is easily generated on the surface of a photoconductor drum. The degree of penetration is measured in accordance with JIS-K2335.

When the wax is required to be extracted from the toner to determine the above properties, any extraction method can be employed without specific limitations.

In one example, a predetermined amount of the toner is Soxhlet extracted with toluene, the solvent is removed from the resulting toluene soluble component, and then a chloroform insoluble component is obtained.

Then, an identification analysis is carried out by IR or the like.

With regard to quantitative determination, a quantitative analysis is carried out by DSC.

A condensed resin may be added to the toner of the present invention, in addition to the binder resin. By adding a condensed resin, the toner by polymerization can exhibit improved granulation properties, environmental stability in the charge quantity, development characteristics, and transfer characteristics. The condensed resin has a weight average molecular weight (Mw) of preferably 6,000 to 100,000, more preferably 6,500 to 85,000, and still more preferably 6,500 to 45,000.

If the condensed resin has a weight average molecular weight of less than 6,000, the external additive on the surface of the toner is easily buried due to endurance in a continuous image output, and transfer characteristics easily decrease. On the contrary, when the condensed resin has a weight average molecular weight of more than 100,000, it costs much time to dissolve the condensed resin in a polymerizable monomer. Further, the polymerizable monomer composition has an increased viscosity, making it difficult to obtain a toner with a small particle size and a uniform particle size distribution.

The condensed resin has a number average molecular weight (Mn) of preferably 3,000 to 80,000, more preferably 3,500 to 60,000, and still more preferably 3,500 to 12,000. The condensed resin has a main peak value (Mp) of the molecular weight distribution in a gel permeation chromatogram (GPC) preferably in a region of molecular weights between 4,500 and 40,000, and more preferably in a region of molecular weights between 6,000 and 30,000. Still more preferably, Mp is in a region of molecular weights between 6,000 and 20,000. If Mn and Mp are outside the above ranges, there are the same disadvantages exhibited by the condensed resin having a weight average molecular weight outside the above range.

The condensed resin has an Mw/Mn of preferably 1.2 to 3.0, and more preferably 1.5 to 2.5. If the Mw/Mn is less than 1.2, the toner has reduced endurance against a large number of pieces and offset resistance. If more than 3.0, the toner has low-temperature fixing properties a little inferior to those of the toner within the range.

The condensed resin has a glass transition temperature (Tg) of preferably 50.0 to 100.0° C., and more preferably 50.0 to 95.0° C. Still more preferably, the Tg is 55 to 90° C. If the glass transition temperature is lower than 50° C., the toner exhibits reduced blocking resistance. If the glass transition temperature is higher than 100° C., the toner exhibits reduced low-temperature offset resistance. Tg shows a value determined by a midpoint method.

The condensed resin has an acid value (mgKOH/g) of 0.1 to 35.0, preferably 3.0 to 35.0, more preferably 4.0 to 35.0, and still more preferably 5.0 to 30.0. If the acid value is smaller than 0.1, the toner exhibits a slow charge build-up and easily causes fogging. If the acid value exceeds 35.0, the toner having been allowed to stand at a high temperature at a high humidity tends to have varied triboelectric charging properties and tends to have varied image densities in a continuous image output. When the condensed resin has an acid value of more than 35.0, since polymers in the condensed resin have strong affinity with each other, it is difficult to dissolve the condensed resin in a polymerizable monomer, and it takes much time to prepare a uniform polymerizable monomer composition.

The condensed resin has a hydroxyl value (mgKOH/g) of 0.2 to 50.0, preferably 5.0 to 50.0, and more preferably 7.0 to 45.0. If the hydroxyl value is less than 0.2, it is difficult for the condensed resin to be localized on the surface of particles of a polymerizable monomer composition in an aqueous medium. If the hydroxyl value exceeds 50.0, the toner having been allowed to stand at a high temperature at a high humidity tends to have charging properties a little lower as compared with such a toner with the optimal range, and tends to have varied image densities in a continuous image output. Any method for extracting the condensed resin can be used without specific limitations.

The condensed resin is used in an amount of preferably 0.1 to 20.0 parts by weight, and more preferably 1.0 to 15.0 parts by weight, based on 100 parts by weight of the binder resin.

The acid value of the resin can be determined as follows. The basic operation is in accordance with JIS-K0070.

The number of milligrams of potassium hydroxide required for neutralizing free fatty acid, resin acid or the like contained in 1 g of a sample is called acid value, and is measured by the following method.

(1) Reagent (a) Preparation of Solvent

As a solvent for a toner sample, a mixed solution of ethyl ether-ethyl alcohol (1+1 or 2+1) or a mixed solution of benzene-ethyl alcohol (1+1 or 2+1) is used. The solution is neutralized before use by 0.1 mol/L of a solution of potassium hydroxide in ethyl alcohol with phenolphthalein as an indicator.

(b) Preparation of Phenolphthalein Solution 1 g of phenolphthalein is dissolved in 100 ml of ethyl alcohol (95 vol %).

(c) Preparation of 0.1 mol/L Potassium Hydroxide-Ethyl Alcohol Solution 7.0 g of potassium hydroxide is dissolved in water with an amount as small as possible, and ethyl alcohol (95 vol %) is added to the solution to provide a 1 L mixture, which is allowed to stand for 2 to 3 days and then filtered. Standardization is carried out in accordance with JIS K-8006 (basic matters for a titration in testing the content of a reagent).

(2) Operation 3 g of a toner sample is accurately weighed, and 100 ml of a solvent and several drops of a phenolphthalein solution as an indicator are added to the sample. The mixture is sufficiently shaken until the sample is completely dissolved. If the sample is a solid, the solid is warmed on a water bath and dissolved. After cooling, the solution is titrated with 0.1 mol/L of the potassium hydroxide-ethyl alcohol solution. The end point of neutralization is when the indicator indicates a light red color for 30 seconds.

(3) Calculation Formula

The acid value is calculated from the following formula.

$$A=B\times f\times 5.611/S$$

A: Acid value (mgKOH/g)

B: Amount of 0.1 mol/L-solution of potassium hydroxide in ethyl alcohol used (ml)

f: Factor of 0.1 mol/L-solution of potassium hydroxide in ethyl alcohol

S: Toner sample (g)

The hydroxyl value of the resin can be determined as follows. The basic operation is in accordance with JIS-K0070.

The number of milligrams of potassium hydroxide required for neutralizing acetic acid bonded to a hydroxyl group when acetylating 1 g of a sample by a specified method is called hydroxyl value, and is measured by the following method.

(1) Reagent (a) Preparation of Acetylated Reagent

A 100 ml-volume measuring flask is charged with 25 ml of acetic anhydride, and pyridine is added to provide a mixture with a total amount of 100 ml, which is sufficiently shaken. (Pyridine may be further added in some cases.) The acetylated reagent is preserved in a brown bottle so that the reagent cannot be in contact with moisture, carbon dioxide and acid steam.

(b) Preparation of Phenolphthalein Solution 1 g of phenolphthalein is dissolved in 100 ml of ethyl alcohol (95 vol %).

(c) Preparation of 0.2 mol/L Potassium Hydroxide-Ethyl Alcohol Solution 35 g of potassium hydroxide is dissolved in water with an amount as small as possible, and ethyl alcohol (95 vol %) is added to the solution to provide a 1 L mixture, which is allowed to stand for 2 to 3 days and then filtered. Standardization is carried out in accordance with JIS-K8006.

(2) Operation 1 g of a toner sample is accurately weighed into a round bottom flask, and 5 ml of the acetylated reagent is accurately added to the sample. The cap of the flask is provided with a small funnel, and is heated in a glycerol bath at 95 to 100° C. with the bottom with a height of about 1 cm immersed therein. In order to prevent a rise in temperature of the neck of the flask with heat of the bath, the base of the neck of the flask is covered with a cardboard disk with a round hole opened therein. After one hour, the flask is taken from the bath and allowed to be cooled. Then, 1 ml of water is added from the funnel, and the mixture is shaken to decompose acetic anhydride. To decompose more completely, the flask is again heated in a glycerol bath for 10 minutes and is allowed to be cooled. Then, the walls of the funnel and the flask are washed with 5 ml of ethyl alcohol, and the product is titrated with 0.2 mol/L of the solution of potassium hydroxide in ethyl alcohol with the phenolphthalein solution as an indicator. A blank test is carried out along with the main test. In some cases, a KOH-THF solution may be used as an indicator.

(3) Calculation Formula

The hydroxyl value is calculated from the following formula.

$$A=\{(B-C)\times f\times 28.05/S\}+D$$

A: Hydroxyl value (mgKOH/g)

B: Amount of 0.5 mol/L-solution of potassium hydroxide in ethyl alcohol used in blank test (ml)

C: Amount of 0.5 mol/L-solution of potassium hydroxide in ethyl alcohol used in main test (ml)

f: Factor of 0.5 mol/L-solution of potassium hydroxide in ethyl alcohol

S: Toner sample (g)

D: Acid value (mgKOH/g)

Condensed resins that can be used in the present invention are resins such as polyester, polycarbonate, a phenol resin, an epoxy resin, polyamide, and cellulose. Polyester is more preferable because of its variety of materials.

The polyester used as the condensed resin and the ester wax used as the crystalline resin are produced by, for example, synthesis by oxidation; synthesis from carboxylic acid and its derivative; introduction of an ester group typified by Michael addition; a method utilizing dehydration condensation from a carboxylic acid compound and an alcohol compound; reaction from an acid halide and an alcohol compound; or ester exchange. The catalyst may be a conventional acidic or alkaline catalyst used for esterification, for example, zinc acetate, or a titanium compound. Then, the resins may be purified by recrystallization, distillation, or the like.

A particularly preferable production method is dehydration condensation from a carboxylic acid compound and an alcohol compound because of its variety of materials and high reactivity.

The composition of the polyester used as the condensed resin will be described below.

The polyester preferably has 45 to 55 mol % of an alcohol component and 55 to 45 mol % of an acid component based on the total components.

Examples of the alcohol component include diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following formula (VII):

(VII)

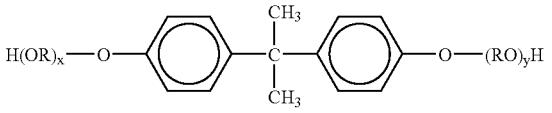

wherein R represents an ethylene or propylene group, x and y each represent an integer of 1 or higher, and an average value of x+y is 2 to 10, and a diol represented by the following formula (VIII):

(VIII)

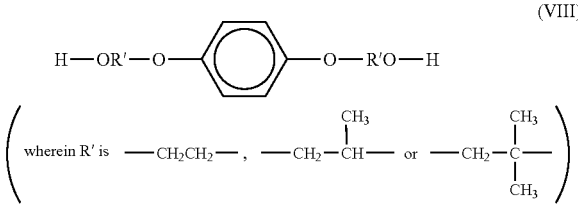

Examples of the divalent carboxylic acid include benzenedicarboxylic acids such as phthalic acid, terephthalic acid, isophthalic acid, phthalic anhydride, diphenyl-4,4'-dicarboxylic acid, naphthalene-2,7-dicarboxylic acid, naphthalene-2,6-dicarboxylic acid, diphenylmethane-4,4'-dicarboxylic acid, benzophenone-4,4'-dicarboxylic acid, and 1,2-diphenoxyethane-4,4'-dicarboxylic acid, or their anhydrides; alkyldicarboxylic acids such as succinic acid, adipic acid, sebacic acid, azelaic acid, glutaric acid, cyclohexanedicarboxylic acid, triethylenedicarboxylic acid, and malonic acid, or their anhydrides; succinic acid substituted with a $C_6$ to $C_{18}$ alkyl group or alkenyl group or its anhydride; and unsaturated dicarboxylic acids such as fumaric acid, maleic acid, citraconic acid, and itaconic acid, or their anhydrides.

A particularly preferable alcohol component is a bisphenol derivative represented by the above formula (VII). Particularly preferable acid components include dicarboxylic acids such as phthalic acid, terephthalic acid, and isophthalic acid, or their anhydrides; succinic acid and n-dodecenylsuccinic acid, or their anhydrides; fumaric acid, maleic acid, and maleic anhydride.

The condensed resin can be obtained by synthesis from divalent dicarboxylic acid and a divalent diol. In some cases, a small amount of trivalent or higher polycarboxylic acid or polyol may be used insofar as the present invention is not adversely affected.

Examples of the trivalent or higher polycarboxylic acid include trimellitic acid, pyromellitic acid, cyclohexanetricarboxylic acids, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methylenecarboxylpropane, 1,3-dicarboxyl-2-methyl-methylenecarboxylpropane, tetra(methylenecarboxyl)methane, and 1,2,7,8-octanetetracarboxylic acid, and their anhydrides.

Examples of the trivalent or higher polyol include sorbitol, 1,2,3,6-hexanetetrol, 1,4-sorbitan, pentaerythritol, dipentaerythritol, tripentaerythritol, sucrose, 1,2,4-methanetriol, glycerol, 2-methylpropanetriol, 2-methyl-1,2,4-butanetriol, trimethylolethane, trimethylolpropane, and 1,3,5-trihydroxymethylbenzene.

In the toner of the present invention, a charge control agent may be used.

As the charge control agent for controlling the toner to be negatively charged, the following substances can be given. Examples include an organometallic compound, a chelate compound, a monoazometallic compound, an acetylacetone metallic compound, a urea derivative, a metal-containing salicylic acid compound, a metal-containing naphthoic acid compound, a tertiary ammonium salt, calixarene, a silicon compound, and a non-metal carboxylic acid compound and its derivative.

As the charge control agent for controlling the toner to be positively charged, the following substances can be given. Examples include nigrosine and its modified product by a fatty acid metal salt; quaternary ammonium salts such as tributylbenzylammonium-1-hydroxy-4-naphthosulfonate and tetrabutylammonium tetrafluoroborate and onium salts as their analogues such as a phosphonium salt, and their lake pigments, and triphenylmethane dyes and their lake pigments, of which laking agents include phosphotungstic acid, phosphomolybdic acid, phosphotungsticmolybdic acid, tannic acid, lauric acid, gallic acid, a ferricyanide, and a ferrocyanide; metal salts of higher fatty acids; diorganotin oxides such as dibutyltin oxide, dioctyltin oxide, and dicyclohexyltin oxide; and diorganotin borates such as dibutyltin borate, dioctyltin borate, and dicyclohexyltin borate. These may be used singly or in a combination of two or more. Of these, charge control agents such as nigrosins and quaternary ammonium salts are particularly preferably used.

The charge control agent is contained in the toner in an amount of preferably 0.01 to 20 parts by weight, and more preferably 0.5 to 10 parts by weight, based on 100 parts by weight of the binder resin in the toner.

The toner of the present invention contains a coloring agent. As the black coloring agent, carbon black, a magnetic material, and a coloring agent toned to black using the yellow/magenta/cyan coloring agent shown below are used.

As the yellow coloring agent, compounds typified by a condensed azo compound, an isoindolynone compound, an anthraquinone compound, an azometal complex methine compound, and an allylamide compound as pigments are used. Specifically, C.I. pigment yellows 3, 7, 10, 12 to 15, 17, 23, 24, 60, 62, 74, 75, 83, 93 to 95, 99, 100, 101, 104, 108 to 111, 117, 123, 128, 129, 138, 139, 147, 148, 150, 166, 168 to 177, 179, 180, 181, 183, 185, 191:1, 191, 192, 193, and 199 are suitably used. Examples of dyes include C.I. solvent yellows 33, 56, 79, 82, 93, 112, 162, and 163, and C.I. disperse yellows 42, 64, 201, and 211.

As the magenta coloring agent, a condensed azo compound, a diketopyrrolopyrrole compound, anthraquinone, a quinacridone compound, a base dye lake compound, a naphthol compound, a benzimidazolone compound, a thioindigo compound, and a perylene compound are used. Specifically, C.I. pigment reds 2, 3, 5 to 7, 23, 48:2, 48:3, 48:4, 57:1, 81:1, 122, 146, 166, 169, 177, 184, 185, 202, 206, 220, 221, and 254, and C.I. pigment violet 19 are particularly preferable.

As the cyan coloring agent, a copper phthalocyanine compound and its derivative, an anthraquinone compound, a base dye lake compound, and the like can be used. Specifically, C.I. pigment blues 1, 7, 15, 15:1, 15:2, 15:3, 15:4, 60, 62, and 66 are particularly suitably used.

These coloring agents may be used singly, in mixture, or as a solid solution. The coloring agent of the present invention is selected in terms of the hue angle, saturation, brightness, weather resistance, OHP transparency, and dispersibility into the toner. The coloring agent is added in an amount of 0.5 to 20 parts by weight based on 100 parts by weight of the binder resin.

Further, the toner of the present invention may contain a magnetic material and be used as a magnetic toner. In this case, the magnetic material may also function as a coloring agent. Examples of the magnetic material contained in a magnetic toner in the present invention include iron oxides such as magnetite, hematite, and ferrite; metals such as iron, cobalt, and nickel, or alloys of these metals with metals such as aluminum, cobalt, copper, lead, magnesium, tin, zinc, antimony, beryllium, bismuth, cadmium, calcium, manganese, selenium, titanium, tungsten, and vanadium; and mixtures of these.

The magnetic material used in the present invention is more preferably a surface modified magnetic material. The magnetic material used in the toner by polymerization is a material hydrophobically treated with a surface modifier as a substance that does not inhibit polymerization. Examples of such a surface modifier include a silane coupling agent and a titanium coupling agent.

These magnetic materials have a mean particle size of preferably 2 μm or smaller, and more preferably 0.1 to 0.5 μm. The magnetic material is contained in the toner in an amount of preferably 20 to 200 parts by weight, and particularly preferably 40 to 150 parts by weight, based on 100 parts by weight of the binder resin.

The magnetic material preferably has magnetic properties when 796 kA/m (10 k oersted) is applied such as a coercive force (Hc) of 1.59 to 23.9 kA/m (20 to 300 oersted), a saturation magnetization (σs) of 50 to 200 emu/g, and a remanent magnetization (σr) of 2 to 20 emu/g.

In the present invention, an external additive is used in order to improve various properties of the toner. The external additive preferably has a particle size ⅕ or smaller of the mean volume diameter of the toner in terms of durability. The particle size of the diameter refers to a mean particle size determined by surface observation of the toner with an electron microscope. As the external additive for providing the properties, the following additives can be used, for example. Examples of the external additive include metal oxides such as silicon oxide, aluminum oxide, titanium oxide, and hydrotalcite; carbon black, and fluorocarbon. More preferably, these additives are hydrophobically treated, respectively.

Examples of the polishing agent include strontium titanate; metal oxides such as cerium oxide, aluminum oxide, magnesium oxide, and chromium oxide; nitrides such as silicon nitride; carbides such as silicon carbide; and metal salts such as calcium sulfate, barium sulfate, and calcium carbonate.

Examples of the lubricant include fluororesin powders such as vinylidene fluoride and polytetrafluoroethylene; and fatty acid metal salts such as zinc stearate and calcium stearate.

Examples of the charge controlling particles include metal oxides such as tin oxide, titanium oxide, zinc oxide, silicon oxide, and aluminum oxide; and carbon black.

These external additives are used in an amount of 0.1 to 10 parts by weight, and preferably 0.1 to 5 parts by weight, based on 100 parts by weight of the toner particles. These external additives may be used singly or in a combination of two or more.

The toner of the present invention has a cohesiveness of preferably 1 to 50%, more preferably 1 to 30%, still more preferably 4 to 30%, and particularly preferably 4 to 20% in terms of development characteristics. If the toner has a small value of cohesiveness, the toner is assessed to have high flowability. If the toner has a large value of cohesiveness, the toner is assessed to have low flowability. The cohesiveness of the toner is measured by the following method.

A vibration sieving machine of a powder tester (manufactured by Hosokawa Micron Corp.) is used. A sieve with an aperture of 33 μm, a sieve with an aperture of 77 μm, and a sieve with an aperture of 154 μm are stacked and set on the vibration table from the bottom in that order, so that the sieve with an aperture of 33 μm (400 mesh), the sieve with an aperture of 77 μm (200 mesh), and the sieve with an aperture of 154 μm (100 mesh) are stacked on the vibration table in an order inversely proportional to the size of aperture. A sample is put on the sieve with an aperture of 154 μm set, the voltage input to the vibration table is set at 15 V, the amplitude of the vibration table at this time is adjusted to be 60 to 90 μm, and vibration is applied for about 25 seconds. Then, the weight of the sample remaining on each sieve is measured to obtain a cohesiveness based on the following formula. As the value of cohesiveness is smaller, the toner exhibits higher flowability. The sample with an amount of 5 g is allowed to stand in a normal temperature and humidity environment (20° C./60% RH) for seven days and measured.

Cohesiveness (%)=(Weight of sample on 154 μm-aperture sieve (g)/5 g)×100

+(Weight of sample on 77 μm-aperture sieve (g)/5 g)×100×0.6

+(Weight of sample on 33 μm-aperture sieve (g)/5 g)×100×0.2

The toner of the present invention preferably has a circle-equivqlent number average diameter D1 (μm) of 2 to 10 μm in a number-based circle-equivqlent diameter-circularity scattergram of the toner measured with a flow particle image measuring device as described later. In addition, the toner preferably has an average circularity of 0.920 to 0.995 and a standard deviation of circularity of less than 0.040. More preferably, the average circularity is 0.950 to 0.995, and the standard deviation of circularity is less than 0.035. Still more preferably, the average circularity is 0.970 to 0.995, and the standard deviation of circularity is 0.015 to less than 0.035. The content of the toner with a circularity of less than 0.950 is preferably 15% by number or less. The number variation coefficient obtained by dividing the standard deviation of the circle-equivqlent number average diameter by the circle-equivqlent number average diameter is preferably 0.35 or less, and particularly preferably 0.30 or less.

The toner with a circle-equivalent number average diameter of 2 to 7 μm exhibits excellent reproducibility in development of the contour of an image, in particular, a character image or line pattern. In general, however, since the toner inevitably has a high content of microparticles when the toner has a small particle size, it is difficult for the toner to be uniformly charged, and thus an image is fogged. Furthermore, the toner has high adhesion to the surface of an electrostatic latent image carrier, or a developer carrier, which easily decreases development characteristics as a result.

However, when the toner has an average circularity in the circularity frequency distribution of 0.920 to 0.995, preferably 0.950 to 0.995, and more preferably 0.970 to 0.995, the toner having a small particle size can have significantly improved transfer characteristics that have been conventionally difficult to be achieved, and also can have remarkably improved developability.

When the toner of the present invention has a standard deviation of circularity of less than 0.040, and preferably less than 0.035, defects related to development characteristics can be significantly improved.

The toner having such an above configuration is highly effective for developing a digital latent image of microspots or for forming a full-color image comprising transferring many times using an intermediate transfer member, and matches an image forming apparatus well.

In the present invention, the average circularity is used as simple means for quantitatively expressing the shape of particles. The average circularity is 1.000 when all toner particles are perfect spheres. As the toner shape is more complicated, the circularity value is smaller. Specifically, the average circularity can be measured with a flow particle image analyzer FPIA-2100 (manufactured by Sysmex Corp.), for example. The circularity is determined from the following formula, and the value obtained by dividing the sum of the circularities of all particles measured as shown in the following formula by the number of all particles is defined as an average circularity.

The average circularity of the toner is measured with a flow particle image measuring device "FPIA-2100" (manufactured by Sysmex Corp.), and is calculated from the following formula.

Circle-Equivalent Diameter= (Particle projected area/$\pi$)$^{1/2}$×2

Circularity=(Circumferential length of circle having the same area as particle projected area)/(Circumferential length of particle projected image)

Here, the "particle projected area" is defined as a binarized area of an image of the toner particles, and the "circumferential length of particle projected image" is defined as a length of the contour line obtained by connecting the edge points of the toner particle image. In the measurement, the circumferential length of the particle image when processed at an image processing resolution of 512×512 (0.3 μm×0.3 μm pixels) is used.

The circularity in the present invention is an index showing the degree of unevenness of the toner. The circularity is 1.000 when the toner particles are perfect spheres. As the surface shape is more complicated, the circularity value is smaller.

The average circularity C referring to a mean value of the circularity frequency distribution is calculated from the following formula, provided that the circularity (central value) at the cutoff point i of the particle size distribution is ci, and the number of measured particles is m.

$$\text{Average circularity } C = \sum_{i=1}^{m} ci/m$$

The standard deviation of circularity SD is calculated from the following formula, provided that the average circularity is C, the circularity in each particle is ci, and the number of measured particles is m.

$$\text{Standard deviation of circularity } SD = \left\{\sum_{i=1}^{m} (C - ci)^2/m\right\}^{1/2}$$

In the measuring device "FPIA-2100" used in the present invention, the circularity of each particle is calculated, and then the average circularity and the standard deviation of circularity are calculated by classifying particles with a circularity of 0.4 to 1.0 into classes segmented by the circularity of 0.01 according to the circularities obtained, and calculating the average circularity and the standard deviation of circularity using the central value at the cutoff point and the number of particles measured.

A specific measuring method comprises preparing 10 ml of ion-exchanged water from which an impure solid or the like is preliminarily removed in a container, adding, as a dispersing agent, a surfactant, preferably alkylbenzenesulfonate, to the water, adding 0.02 g of a sample to be measured further, and uniformly dispersing the components. As dispersing means, an ultrasonic dispersing machine "Tetora 150" (manufactured by Nikkaki-Bios Co., Ltd.) is used. Dispersion treatment is carried out for two minutes to prepare a dispersion for measurement. At this time, the dispersion is appropriately cooled so that the temperature is not 40° C. or higher. In order to reduce the variation in circularity, the installation environment for the flow particle image analyzer FPIA-2100 is controlled at 23° C.±0.5° C. so that the device has an internal temperature of 26° C. to 27° C., and the focus is automatically adjusted with 2 μm latex particles at an interval of a predetermined time, preferably at an interval of two hours.

The circularity of the toner is measured with the above flow particle image measuring device. The concentration of the dispersion is adjusted again so that the toner concentration when measuring is 3,000 to 10,000 particles/μl, and 1,000 or more particles of the toner are measured. After the measurement, the average circularity of the toner is determined using the data, provided that the data for particles with a circle-equivqlent diameter of 2 μm are eliminated.

Further, the measuring device "FPIA-2100" used in the present invention has an improved magnification of the particle image to be processed, has an improved processing resolution of the captured image (256×256–>512×512), and thus has an increased accuracy of measuring the shape of a toner, as compared with "FPIA-1000" that has been conventionally used for calculating the shape of a toner. The device thus achieves more reliable acquisition of microparticles. Accordingly, when it is necessary to measure the shape more accurately as in the present invention, FPIA-2100 by which information on the shape can be obtained more accurately is more useful.

Next, the process for producing a toner of the present invention will be described.

Examples of the process for producing a toner of the present invention include toner production by a process of producing a toner directly by suspension polymerization disclosed in Japanese Patent Publication No. 36-10231, Japanese Patent Application Laid-Open No. 59-53856, or Japanese Patent Application Laid-Open No. 59-61842; toner production by emulsion polymerization typified by soap-free polymerization comprising producing a toner by direct polymerization in the presence of a water-soluble polymerization initiator soluble in a monomer; toner production by interfacial polymerization such as a microencapsulation process, or in-situ polymerization; toner production by coacervation; toner production by association polymerization comprising causing cohesion of at least one kind of microparticles as disclosed in Japanese Patent Application Laid-Open No. 62-106473 or Japanese Patent Application Laid-Open No. 63-186253 to obtain a toner with a desired particle size; toner production by dispersion polymerization characterized by monodispersion; toner production by emulsion dispersion comprising dissolving necessary resins in a water-insoluble organic solvent and then producing a toner in the water; pulverization comprising kneading and uniformly dispersing toner components using a pressure kneader, an extruder, a media dispersion machine, or the like, then cooling, causing the kneaded product to collide with a target mechanically or in a jet stream to pulverize the product into toner particles with a desired particle size, and making the particle size distribution sharp in a classification step to produce a toner; and a process for obtaining a toner by converting the toner obtained in the pulverization into spheres with heat or the like in a solvent.

Particularly preferably, the process for producing a toner of present invention is a process for producing a toner, comprising at least a granulation step comprising dispersing a polymerizable monomer composition comprising at least a coloring agent, a wax, and a polymerizable monomer for synthesizing a binder resin in an aqueous dispersion medium, and granulating the composition to produce particles of the polymerizable monomer composition; a polymerization step comprising heating the particles of the polymerizable monomer composition to 70.0 to 95.0° C. in the aqueous dispersion medium, and polymerizing the polymerizable monomer in the polymerizable monomer composition to produce toner particles; and a cooling step comprising cooling the toner particles to 45.0° C. or lower from 70.0 to 95.0° C. at a cooling rate of 0.01° C./min to 2.00° C./min, the toner produced by the process for producing a toner having, in a DSC curve obtained by measuring the toner with differential scanning calorimeter, a glass transition temperature (Tg1) measured in a first scan of 50.0 to 70.0° C. and a temperature difference (Tg1−Tg2) between the glass transition temperature (Tg1) measured in the first scan and a glass transition temperature (Tg2) measured in a second scan of 3.0 to 20.0° C. By heating to 70.0 to 95.0° C. (preferably 75.0 to 85.0° C.) to increase compatibility of the wax component with the binder resin component, and then slowly cooling at a cooling rate of 0.01° C. to 2.00° C./min, crystallization of the wax component can be promoted.

The cooling step is preferably a cooling step comprising cooling the toner particles to 45.0° C. or lower from 70.0 to 95.0° C. at a cooling rate of 0.01° C./min to 0.50° C./min. More preferably, the cooling step comprises cooling the toner particles to 45.0° C. or lower from 70.0 to 95.0° C. at a cooling rate of 0.01° C./min to less than 0.25° C./min.

The cooling step may be either a cooling step comprising cooling the toner particles in an aqueous dispersion medium or a cooling step comprising taking the toner particles from an aqueous dispersion medium and cooling the toner particles.

In the step of heating to 70.0° C. or higher, heating to 70.0° C. or higher may be carried out while forming toner particles by suspension polymerization, association polymerization, emulsification dispersion, or dispersion polymerization. Alternatively, heating to 70.0° C. or higher may be carried out with the toner particles prepared by a known method dispersed in an aqueous dispersion medium again. As the aqueous dispersion medium, media in which the toner cannot be substantially dissolved such as water and alcohols can be suitably used.

Suspension polymerization in which the toner with a small particle size can be easily obtained is more preferable. Further, seed polymerization comprising causing a monomer to be further adsorbed on the polymer particles once obtained and then polymerizing using a polymerization initiator can also be suitably used in the present invention. At this time, a polar compound may be dispersed or dissolved in the monomer for use caused to be adsorbed.

When suspension polymerization is used as the process for producing a toner, the toner can be directly produced by the production process as follows. At least a polymerizable monomer for synthesizing a binder resin, a wax, and a coloring agent are uniformly dissolved and dispersed with a homogenizer and a stirrer such as an ultrasonic dispersion machine to form a polymerizable monomer composition. At this time, according to need, a crosslinking agent and other additives may be contained in the polymerizable monomer composition. The composition is dispersed in the aqueous dispersion medium that has a dispersion stabilizer containing magnesium, calcium, valium, zinc, aluminum, or phosphorus with a conventional stirrer or a homomixer or homogenizer. At this time, a polymerization initiator may be contained in at least either of the polymerizable monomer composition and the aqueous dispersion medium. Granulation is preferably carried out by adjusting the stirring rate and the stirring time so that droplets of the polymerizable monomer composition have a desired toner size. After that, stirring may be carried out to the extent that the particle state can be maintained and sedimentation of the particle can be prevented by the action of the dispersion stabilizer. The polymerization temperature is set at 40.0° C. or higher, and usually 50.0 to 95.0° C. (preferably 55.0 to 85.0° C.) to carry out polymerization. The temperature may be raised in the latter half of polymerization, and pH may be changed as required. The composition is maintained at 70.0 to 95.0° C. for three minutes or longer when the polymerization is terminated, and then cooled to 45.0° C. or lower (preferably 5.0 to 35.0° C.) at a cooling rate of 0.01 to 2.00° C./min to wash and dry the toner particles.

The polymerizable monomer composition is preferably formed by adding other additives as required after a step of forming a coloring agent composition which has a polymerizable monomer and a coloring agent, and a step of dispersing the coloring agent composition. In order to improve dispersibility of the coloring agent, a charge control agent, a known pigment dispersing agent, and other resins may be added.

The polymerizable monomer composition is preferably a polymerizable monomer composition obtained by preparing a dispersion A in which at least a polymethylene wax is dispersed, and then mixing the dispersion A with a dispersion B containing at least an ester wax. This configuration tends to form a good crystalline structure formed easily, and tends to make the dispersion state of the wax in the toner multicentric and needle-like in the toner production step. Accordingly, development stability and high-temperature offset resistance are made further better.

Although there are no specific limitations to pH in the aqueous dispersion medium during granulating, pH is preferably 4.5 to 13.0, more preferably 4.5 to 12.0, particularly preferably 4.5 to 11.0, and most preferably 4.5 to 7.5. If pH is less than 4.5, a part of the dispersion stabilizer is dissolved, making it difficult to stabilize the dispersion, so that the granulation may be impossible. If pH is more than 13.0, components added in the toner may decompose, and it may be impossible for the toner to exhibit sufficient charging performance. When the granulation is carried out in an acidic region, the content of a metal derived from the dispersion stabilizer in the toner can be prevented from being excessive, and the toner which fulfills the provisions of the present invention can be easily obtained.

The toner particles are washed with an acid having a pH of preferably 3.0 or less, and more preferably 1.5 or less. By washing the toner particles with an acid, it is possible to reduce the amount of the dispersion stabilizer on the surface of the toner particles. As the acid used for washing, inorganic acids such as hydrochloric acid and sulfuric acid can be used without specific limitations.

Examples of the dispersion stabilizer used in the present invention include magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatite.

Used as the dispersion stabilizer is a stabilizer containing at least any of magnesium, calcium, valium, zinc, aluminum, and phosphorus, and preferably a stabilizer containing any of magnesium, calcium, aluminum, and phosphorus.

The above dispersion stabilizer may be used in a combination of an organic compound, for example, polyvinyl alcohol, gelatin, methylcellulose, methylhydroxypropylcellulose, ethylcellulose, a sodium salt of carboxymethylcellulose, or starch.

These dispersion stabilizers are preferably used in an amount of 0.01 to 2.00 parts by weight based on 100 parts by weight of the polymerizable monomer.

Further, in order to refine these dispersion stabilizers, 0.001 to 0.1% by weight of a surfactant may be used in combination. Specifically, commercially available nonionic, anionic, and cationic surfactants can be used. For example, sodium dodecylsulfate, sodium tetradecylsulfate, sodium pentadecylsulfate, sodium octylsulfate, sodium tetradecylsulfate, sodium pentadecylsulfate, sodium octylsulfate, sodium oleate, sodium laurate, potassium stearate, and calcium oleate are preferably used.

As the polymerizable monomer used for producing the toner of the present invention by polymerization, a vinyl polymerizable monomer that is radical polymerizable is used.

As the vinyl polymerizable monomer, a monofunctional polymerizable monomer or a polyfunctional polymerizable monomer can be used. Examples of the monofunctional polymerizable monomer include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylates; vinyl esters such as vinyl acetate, vinyl propionate, vinyl butyrate, vinyl benzoate, and vinyl formate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

Examples of the polyfunctional polymerizable monomer include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy.diethoxy)phenyl]propane, trimethylolpropane triacylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy.diethoxy)phenyl]propane, 2,2'-bis[4-(methacryloxy.polyethoxy)phenyl]propane, trimethylolpropane trimethacrylate, tetramethylolmethane tetramethacrylate, divinylbenzene, divinylnaphthalene, and divinyl ether.

In the present invention, the above-described monofunctional polymerizable monomer is used singly, in a combination of two or more, or in a combination of the above-described monofunctional polymerizable monomer with the polyfunctional polymerizable monomer. The polyfunctional polymerizable monomer may also be used as a crosslinking agent.

As the polymerization initiator used for polymerization of the above-described polymerizable monomer, an oil-soluble initiator and/or a water-soluble initiator can be used. Examples of the oil-soluble initiator include azo compounds such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide initiators such as acetylcyclohexylsulfonyl peroxide, diisopropyl peroxycarbonate, decanonyl peroxide, lauroyl peroxide, stearoyl peroxide, propionyl peroxide, acetyl peroxide, tert-butyl peroxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, and cumene hydroperoxide.

Examples of the water-soluble initiator include ammonium persulfate, potassium persulfate, 2,2'-azobis(N,N'-dimethyleneisobutyroamidine) hydrochloride, 2,2'-azobis(2-amidinopropane) hydrochloride, azobis(isobutylamidine) hydrochloride, sodium 2,2'-azobisisobutyronitrilesulfonate, ferrous sulfate, and hydrogen peroxide.

In the present invention, in order to control the degree of polymerization of the polymerizable monomer, a chain transfer agent, a polymerization inhibitor, and the like can be further added and used.

In the present invention, a crosslinked resin can be prepared using a crosslinking agent. As the crosslinking agent, a compound having two or more polymerizable double bonds can be used. Examples include aromatic divinyl compounds such as divinylbenzene and divinylnaphthalene; carboxylates having two double bonds such as ethylene glycol diacrylate, ethylene glycol dimethacrylate, and 1,3-butanediol dimethacrylate; divinyl compounds such as divinylaniline, divinyl ether, divinyl sulfide, and divinylsulfone; and compounds having three or more vinyl groups. These may be used singly or in a mixture.

The toner of the present invention can be used as a toner for a one-component developer, or can be used as a toner for a two-component developer having carrier particles.

In the case of a magnetic toner used as a one-component developer and containing a magnetic material, the magnetic toner may be transported and charged with a built-in magnet in a development sleeve. In the case of using a nonmagnetic toner not containing a magnetic material, the toner may be transported by triboelectrically charging the toner forcibly in a development sleeve and thereby causing the toner to be attached onto the sleeve, using a blade or roller.

In the case of using as a two-component developer, the toner is used as a developer in which the toner of the present invention is mixed with a carrier. The magnetic carrier is constituted by a single element selected from the group consisting of iron, copper, zinc, nickel, cobalt, manganese, and chromium, or in the state of a composite ferrite. The magnetic carrier may have any of a globular shape, a flat shape, and an amorphous shape. Further, it is preferable to control even the microstructure of the surface of the magnetic carrier particles (e.g. surface unevenness). Generally, the above inorganic oxide is sintered and granulated to produce core particles of a magnetic carrier in advance, and then the resin is coated with the particles. In order to reduce the load of the magnetic carrier on the toner, it is possible to knead the inorganic oxide and the resin, and then carry out pulverization and classification to obtain a low-density dispersed carrier, or alternatively, it is possible to carry out suspension polymerization of a kneaded product of the inorganic oxide and the monomer directly in the aqueous medium to a perfectly globular magnetic carrier.

A coated carrier in which the surface of the carrier particles is coated with the resin is particularly preferable. As the coating method, a method comprising dissolving or suspending the resin in a solvent and applying and attaching the solution or suspension to the carrier, or a method comprising mixing the resin powder with the carrier particles simply and attaching the mixture can be applied.

Examples of the material for coating the surface of the carrier particles, which varies according to the toner material, include polytetrafluoroethylene, a monochlorotrifluoroethylene polymer, polyvinylidene fluoride, a silicone resin, a polyester resin, a styrene resin, an acrylic resin, polyamide, polyvinyl butyral, and an aminoacrylate resin. These may be used singly or in a mixture.

The carrier preferably has the following magnetic properties. The intensity of magnetization at 79.6 kA/m (1 k oersted) ($\sigma 1000$) after the carrier is magnetically saturated is preferably 30 to 300 emu/cm$^3$. In order to achieve higher image quality, the intensity of magnetization is more preferably 100 to 250 emu/cm$^3$. If higher than 300 emu/cm$^3$, it is difficult to obtain a toner image with high image quality. On the contrary, if lower than 30 emu/cm$^3$, the magnetic force is reduced, and thus attachment of the carrier easily occurs.

For the carrier shape, SF-1 showing the degree of roundness is preferably 180 or less, and SF-2 showing the degree of unevenness is preferably less than 250. SF-1 and SF-2 are defined by the following formula, and measured with Luzex III manufactured by Nireco Corp.

$$SF-1 = \frac{(\text{Maximum length of carrier})^2}{\text{Projected area of carrier}} \times \frac{\pi}{4} \times 100$$

$$SF-2 = \frac{(\text{Circumferential length of carrier})^2}{\text{Projected area of carrier}} \times \frac{1}{4\pi} \times 100$$

Figure 5A:
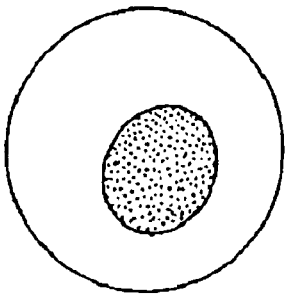
FIGS. 5A, 5B and 5C are views showing the crystalline state of a wax in a toner.
Figure 5B:
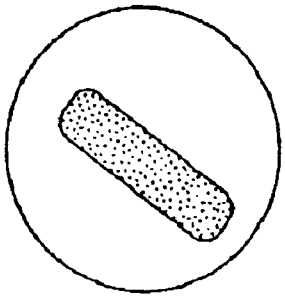
Figure 5C:
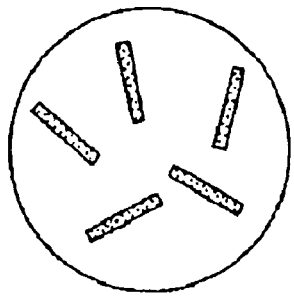

The toner of the present invention preferably contains a wax with a fault plane having a needle-like or rod-like shape observed with a transmission electron microscope (TEM). Typical examples are shown in FIGS. 5A, 5B, and 5C. The toner having these shapes can be susceptible to heat transfer in the fixing step, and can exhibit better low-temperature fixing properties.

Figure 6A:
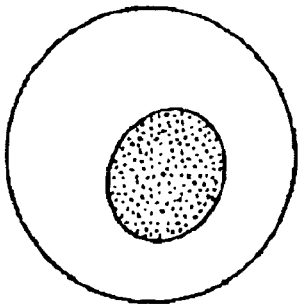
FIGS. 6A and 6B are views showing the dispersion state of a wax in a toner.
Figure 6B:
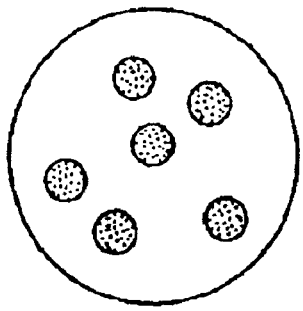

The dispersion state may be a monocentric or multicentric state, but is preferably a multicentric state. The multicentric state makes the toner susceptible to heat transfer in the fixing step, and provides the toner with better low-temperature fixing properties. Typical examples are shown in FIGS. 6A and 6B.

Preferably used as the method for observing the fault plane of the toner particles is electron staining comprising using the difference in the microstructures of the crystalline phase and noncrystalline phase between the wax component used and the binder resin constituting the shell to increase the electron density of one of the components with a heavy metal, thereby providing a contrast between the materials. Specifically, the toner particles are sufficiently dispersed in an epoxy resin curable at room temperature, and then the dispersion is cured in an atmosphere at 40° C. for two days. The resulting cured product is electron-stained with ruthenium tetroxide ($RuO_4$) used in a combination with osmium tetroxide ($OsO_4$) as required, and a sample flake is cut off using an ultramicrotome equipped with a diamond knife to observe the form of the fault plane of the toner with a transmission electron microscope (TEM).

When the toner of the present invention is mixed with the magnetic carrier to prepare a two-component developer, if the mixing ratio is set so that the toner concentration in the developer is 2 to 15% by weight, and preferably 4 to 13% by weight, good results can be usually obtained.

EXAMPLES

The present invention will be described more specifically below with reference to examples. However, the present invention is not limited to these examples.

Preparation Example of Ester Wax 1

1,900 parts by weight of benzene, 1,400 parts by weight of a mixture (carboxylic acid component) composed of myristic acid ($C_{14}H_{28}O_2$), palmitic acid ($C_{16}H_{32}O_2$), stearic acid ($C_{18}H_{36}O_2$), arachic acid ($C_{20}H_{40}O_2$), and behenic acid ($C_{20}H_{40}O_2$), 1,300 parts by weight of a mixture (alcohol component) composed of butyl alcohol ($C_4H_{10}O$), myristyl alcohol ($C_{14}H_{30}O$), palmityl alcohol ($C_{16}H_{34}O$), stearyl alcohol ($C_{18}H_{38}O$), and arachyl alcohol ($C_{20}H_{42}O$), and 130 parts by weight of p-toluenesulfonic acid were added to a four-necked flask equipped with a Dimroth reflux condenser and a Dean-Stark water separator. The mixture was refluxed for six hours with stirring, and then water was azeotropically removed by distillation from the water separator. The residue was sufficiently washed with sodium hydrogencarbonate and then dried. Benzene was removed by distillation. The product was recrystallized with benzene, washed, and purified to obtain an ester wax 1.

Preparation Examples of Ester Waxes 2 to 4

Ester waxes 2 to 4 were prepared in the same manner as in Preparation-Example of the ester wax 1, except for changing the type and the amount of the carboxylic acid component and the alcohol component.

TABLE 1

| Ester wax | Melting point (° C.) | Difference between melting point and onset value (° C.) | Difference between melting point and offset value (° C.) | Weight average molecular weight (Mw) | Number average molecular weight (Mn) | Mw/Mn | Ester compound with highest content | Number of carbon atoms contained in said ester compound | Content of said ester compound (wt. %) |
|---|---|---|---|---|---|---|---|---|---|
| Ester wax 1 | 59.4 | 2.3 | 2.1 | 440 | 380 | 1.16 | $C_{15}H_{31}COOC_{16}H_{33}$ | 31 | 84 |
| Ester wax 2 | 68.6 | 4.1 | 3.9 | 570 | 480 | 1.19 | $C_{19}H_{39}COOC_{20}H_{41}$ | 39 | 63 |
| Ester wax 3 | 63.2 | 2.5 | 2.4 | 490 | 420 | 1.17 | $C_{17}H_{35}COOC_{18}H_{37}$ | 35 | 72 |
| Ester wax 4 | 54.8 | 1.7 | 1.5 | 370 | 350 | 1.06 | $C_{21}H_{43}COOC_4H_9$ | 25 | 98 |
| Ester wax 5 | 71.8 | 5.8 | 5.5 | 610 | 420 | 1.45 | $C_{21}H_{43}COOC_{22}H_{45}$ | 43 | 46 |

TABLE 2

| Polymethylene wax | | Melting point (° C.) | Difference between melting point and onset value (° C.) | Difference between melting point and offset value (° C.) | Weight average molecular weight (Mw) | Number average molecular weight (Mn) | Mw/Mn |
|---|---|---|---|---|---|---|---|
| Polymethylene wax 1 | $—(CH_2)_n—$ | 89.8 | 13.6 | 12.8 | 2390 | 1830 | 1.31 |
| Polymethylene wax 2 | $—(CH_2)_n—$ | 106.3 | 17.5 | 21.3 | 2820 | 2010 | 1.40 |
| Polymethylene wax 3 | $—(CH_2)_n—$ | 78.6 | 8.2 | 7.7 | 1850 | 1460 | 1.27 |

Example 1

The ester wax 1 and a polymethylene wax 1 as crystalline resins were used in combination as follows. A mixture composed of:

100 parts by weight of styrene,
8 parts by weight of the polymethylene wax 1,
12 parts by weight of C.I. pigment blue 15:3, and
6 parts by weight of a charge control agent
(an aluminum compound of di-tert-butylsalicylic acid)

was dispersed using an attritor (manufactured by Mitsui Mining & Smelting Co., Ltd.) for three hours to prepare a wax dispersion A.

350 parts by weight of ion-exchanged water and 225 parts by weight of a 0.1 mol/L aqueous solution of $Na_3PO_4$ were added to a 2 L-volume four-necked flask equipped with a high-speed stirrer TK-homomixer. The homomixer was adjusted to have a rotational frequency of 12,000 rpm, and the mixture was heated to 65.0° C. 34 parts by weight of a 1.0 mol/L aqueous solution of $CaCl_2$ was gradually added to the mixture to prepare an aqueous dispersion medium containing a minute and poorly water-soluble dispersing agent $Ca_3(PO_4)_2$. A wax dispersion B composed of:

63 parts by weight of the wax dispersion A,
33 parts by weight of styrene,
17 parts by weight of n-butyl acrylate,
0.2 part by weight of divinylbenzene,
5 parts by weight of a saturated polyester resin
(a terephthalic acid-propylene oxide modified bisphenol A copolymer, acid value: 15 mgKOH/g), and
9 parts by weight of the ester wax 1 was maintained at 65° C. for five minutes with stirring, and 2 parts by weight of 2,2'-azobis(2,4-dimethylvaleronitrile) as a polymerization initiator was further added to prepare a polymerizable monomer composition. The composition was fed into the aqueous dispersion medium and granulated for 15 minutes while maintaining the rotation frequency at 12,000 rpm. Then, a conventional propeller stirrer was used instead of the high-speed stirrer, and the stirrer was maintained at a rotation frequency of 150 rpm. The composition was polymerized at an internal temperature of 70.0° C. for six hours, and polymerized at an internal temperature raised to 80.0° C. for four hours. After termination of the polymerization, the internal temperature was cooled to 24.0° C. at a cooling rate of 0.40° C./min while maintaining the rotation. Dilute hydrochloric acid was added to the aqueous dispersion medium while maintaining the internal temperature at 20.0° C. to 25.0° C. to dissolve the poorly water-soluble dispersing agent. Washing and drying were further carried out to obtain toner particles.

2.5 parts by weight of dry silica with a primary particle size of 12 nm treated with silicone oil and hexamethyldisilazane (BET specific surface area: 120 $m^2/g$) was externally added to 100 parts by weight of the resulting toner particles to obtain a toner 1 with a weight average particle size of 6.3 μm.

Figure 2:
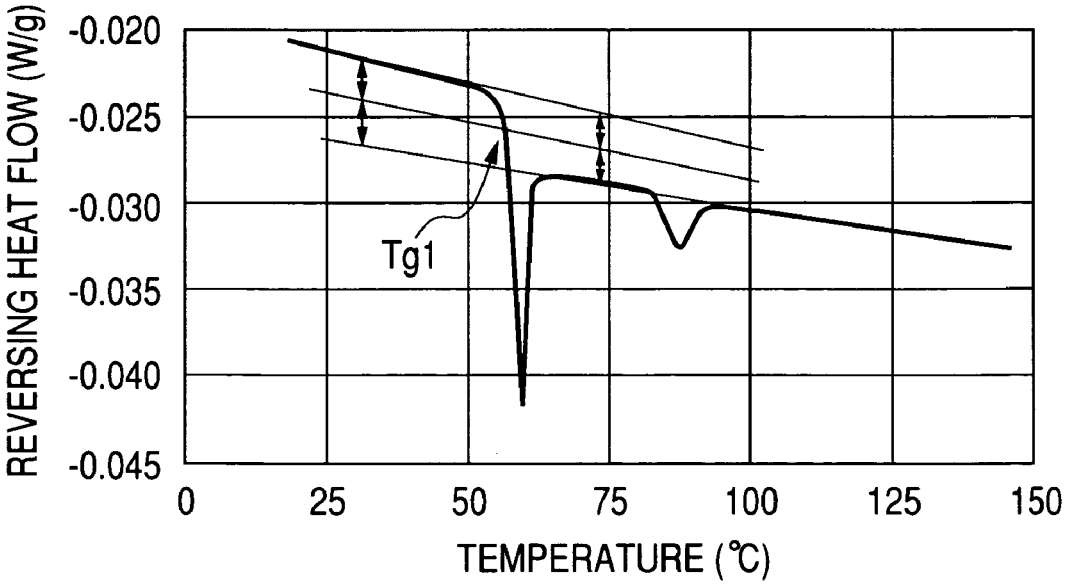
FIG. 2 is a DSC curve obtained by measuring a toner of Example 1 in a first scan.
Figure 3:
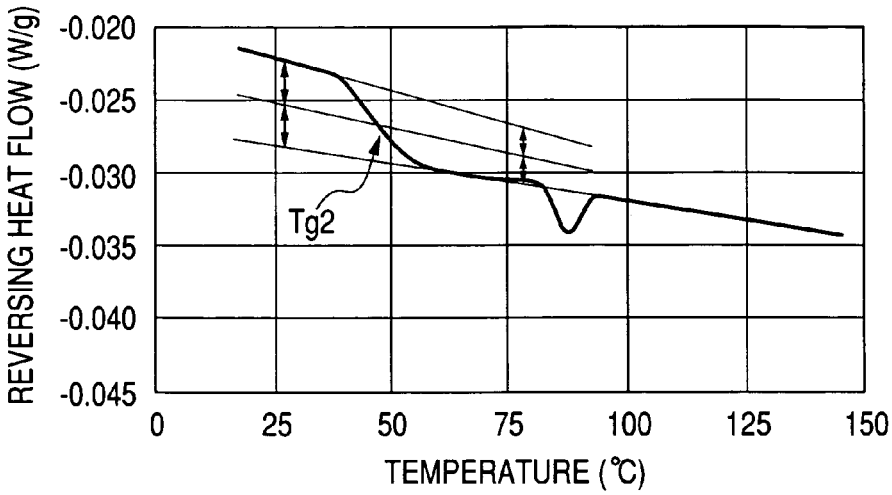
FIG. 3 is a DSC curve obtained by measuring a toner of Example 1 in a second scan.
Figure 4:
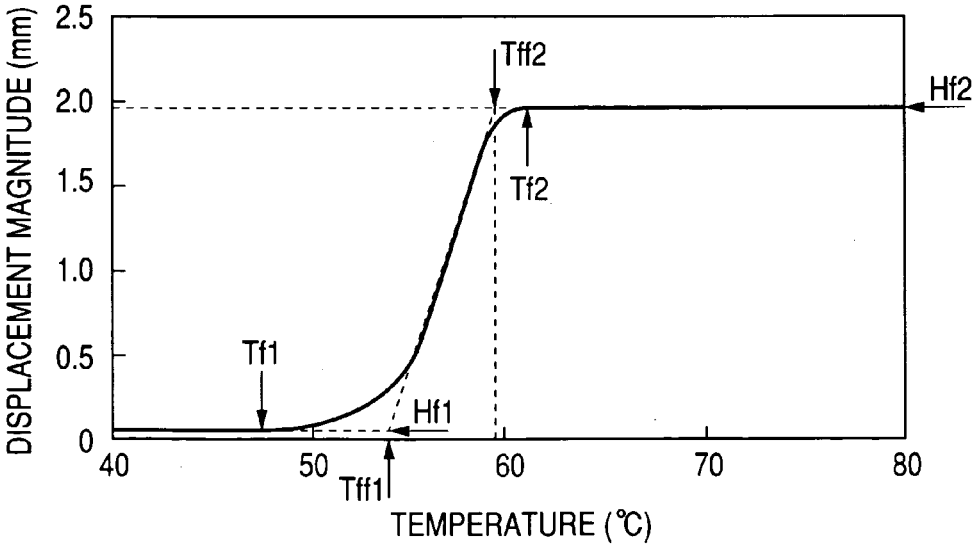
FIG. 4 is an example of a chart obtained by measuring a transformation initiation temperature, transformation termination temperature, and transformation coefficient as specified in the present invention.

The toner 1 was evaluated according to the test methods described later. Properties and evaluation results of the toner 1 are shown in Tables 3 to 6. The DSC curve obtained by measuring the toner 1 in a first scan is shown in FIG. 2, and the DSC curve obtained by measuring the toner 1 in a second scan is shown in FIG. 3. The toner 1 exhibited excellent low-temperature fixing properties and offset resistance. Regarding to development stability, the toner 1 provided an initial image and an endurance image, both of which had a high image density, exhibited no fogging, were clear, and had high image quality. The charge quantity of the toner after endurance was not reduced as compared with the initial period. Further, the toner exhibited very excellent storage stability.

[Method for Measuring Transformation Initiation Temperature, Transformation Termination Temperature, and Transformation Coefficient of Toner]

0.2 g of the toner was weighed on a pressure forming machine, and was pressure formed at a load of 200 kgf for two minutes in a normal temperature and pressure environment to prepare a columnar sample with a diameter of about 8 mm and a height of 2 mm. The columnar sample was set in an apparatus in which a flow tester (manufactured by Shimadzu Corp.) was remodeled so that a SUS-316 plate not holed was used instead of a die on which the sample was to be placed. After maintaining the sample at 35.0° C. for five minutes, a load of 10 kgf was applied to the pressure jig, and the columnar sample was heated to 120.0° C. at a rate of temperature rise of 1.0° C./min to measure the displacement magnitude of the pressure jig in contact with the sample.

[Method for Testing Offset Resistance]

The toner 1 was mixed with a ferrite carrier surface-coated with a silicone resin (mean particle size: 42 μm) with a toner concentration of 6% by weight to prepare a two-component developer. A toner image not fixed was formed on a sheet of receiver paper (80 g/m$^2$) using a commercially available full-color digital copier (CLC700, manufactured by Canon Inc.). A fixing unit removed from the commercially available full-color digital copier (CLC700, manufactured by Canon Inc.) was remodeled so that the fixing temperature could be adjusted, and a fixing test was carried out for the image not fixed using this unit. In a normal temperature and normal humidity environment, the process speed was set at 200 mm/s, and the toner image was fixed at each temperature while changing temperatures every increment of 5° C. in the range of 130° C. to 230° C. The temperature at which a low temperature offset was not observed was defined as an initiation temperature on the low temperature side of offset resistance. The temperature at which a high temperature offset was visually observed, or the temperature 5° C. lower than the temperature at which the sheet of receiver paper was wound around the fixing device, was defined as a termination temperature on the high temperature side.

[Method for Testing Low-Temperature Fixing Properties]

The fixed image obtained in the above test was rubbed with a sheet of lint-free paper under a load of 50 g/cm$^2$. The fixing temperature at which reduction in the density before and after the rubbing was 5% or less was defined as an initiation temperature on the low temperature side of low-temperature fixing properties, and the temperature with maximum gloss was defined as a termination temperature on the high temperature side. The temperature at which a high temperature offset was visually observed, or the temperature 5° C. lower than the temperature at which the sheet of receiver paper was wound around the fixing device, was defined as a termination temperature on the high temperature side.

[Method for Testing Storage Stability]

10 g of the toner was put in a 100 cm$^3$-volume polyethylene cup, allowed to stand at 50° C. for seven days, and visually observed. Evaluation standards for storage stability are shown below.

A: No cohesions are observed.

B: Only a few cohesions are observed.

C: Somewhat numerous cohesions are observed, but easily disintegrate.

D: Almost all of the toner coheres and does not easily disintegrate.

[Method for Measuring Image Density]

Development stability was evaluated by the following standard. The image density was measured as a density relative to a print-out image of the blank part with a manuscript density of 0.00 using a "Macbeth reflection densitometer RD918" (manufactured by Macbeth AG).

[Method for Measuring Charge Quantity]

The two-component developer used in the test for fixing properties was used, and a commercially available full-color digital copier (CLC700, manufactured by Canon Inc.) was used. Images were formed on 5,000 sheets in a normal temperature and normal humidity environment, while supplying the toner serially as required. A part of the developer on the developing sleeve was collected to measure the charge quantity of the toner.

Example 2

Toner particles were obtained in the same manner as Example 1, except for using the ester wax 2 instead of the ester wax 1, and using a polymethylene wax 2 instead of the polymethylene wax 1, as shown in Table 3. A toner 2 with a weight average particle size of 6.5 μm was produced in the same manner as in Example 1 and evaluated. Properties and evaluation results of the toner 2 are shown in Tables 3 to 6. The toner 2 had offset resistance and low-temperature fixing properties a little inferior to those of the toner of Example 1, but exhibited good other properties without problems.

Example 3

A mixture composed of:
100 parts by weight of styrene,
12 parts by weight of C.I. pigment blue 15:3, and
6 parts by weight of a charge control agent
(an aluminum compound of di-tert-butylsalicylic acid)

was dispersed for three hours using an attritor (manufactured by Mitsui Mining & Smelting Co., Ltd.) to prepare a pigment dispersion.

350 parts by weight of ion-exchanged water and 225 parts by weight of a 0.1 mol/L aqueous solution of $Na_3PO_4$ were added to a 2 L-volume four-necked flask equipped with a high-speed stirrer TK-homomixer. The homomixer was adjusted to have a rotational frequency of 12,000 rpm, and the mixture was heated to 65.0° C. 34 parts by weight of a 1.0 mol/L aqueous solution of $CaCl_2$ was gradually added to the mixture to prepare an aqueous dispersion medium containing a minute and poorly water-soluble dispersing agent $Ca_3(PO_4)_2$. A mixture composed of:
59 parts by weight of the pigment dispersion,
33 parts by weight of styrene,
17 parts by weight of n-butyl acrylate,
0.2 part by weight of divinylbenzene,
5 parts by weight of a saturated polyester resin
(a terephthalic acid-propylene oxide modified bisphenol A copolymer, acid value: 15 mgKOH/g),
10 parts by weight of the ester wax 3, and
3 parts by weight of a polymethylene wax 3 was maintained at 65° C. for five minutes with stirring, and 2 parts by weight of 2,2'-azobis(2,4-dimethylvaleronitrile) as a polymerization initiator was added to prepare a polymerizable monomer composition. The polymerizable monomer composition was fed into the aqueous dispersion medium and granulated for 15 minutes while maintaining the rotation frequency at 12,000 rpm. Then, a conventional propeller stirrer was used instead of the high-speed stirrer, and the stirrer was maintained at a rotation frequency of 150 rpm. The composition was polymerized at an internal temperature of 70.0° C. for six hours, and polymerized at an internal temperature raised to 80.0° C. for four hours. After termination of the polymerization, the internal temperature was cooled to 24.0° C. at a cooling rate of 0.40° C./min while maintaining the rotation. Dilute hydrochloric acid was added to the aqueous dispersion medium while maintaining the internal temperature at 20.0° C. to 25.0° C. to dissolve the poorly water-soluble dispersing agent. Washing and drying were further carried out to obtain toner particles.

A toner 3 with a weight average particle size of 6.4 μm was produced in the same manner as in Example 1 and evaluated. Properties and evaluation results of the toner 3 are shown in Tables 3 to 6. The toner 3 had low-temperature fixing properties a little inferior to those of the toner of Example 1, but exhibited good other properties without problems.

Example 4

Toner particles were obtained in the same manner as in Example 3, except for not using the polymethylene wax 3 and adding the ester wax 3 in an amount of 18 parts by weight.

A toner 4 with a weight average particle size of 6.3 μm was produced in the same manner as in Example 1 and evaluated. Properties and evaluation results of the toner 4 are shown in Tables 3 to 6. The toner 4 had offset resistance and low-temperature fixing properties a little inferior to those of the toner of Example 1, but exhibited good other properties without problems.

Comparative Example 1

Toner particles were obtained in the same manner as in Example 1, except for using the ester wax 4 instead of the ester wax 1 and adding the polymerization initiator in an amount of 7 parts by weight.

A toner 5 with a weight average particle size of 5.9 μm was produced in the same manner as in Example 1 and evaluated. Properties and evaluation results of the toner 5 are shown in Tables 3 to 6. Although low-temperature fixing properties were good, maximum gloss was exhibited at 195° C., and too much an amount of the toner seeped into a sheet of paper at a temperature above 195° C., whereby the image quality was reduced. Further, the image density was reduced in an image after 5,000 sheet-endurance, and the charge quantity of the toner was reduced as compared with the initial period. Furthermore, the toner exhibited inferior storage stability.

Comparative Example 2

Toner particles were obtained in the same manner as in Example 4, except for using an ester wax 5 instead of the ester wax 3 and adding the polymerization initiator in an amount of 7 parts by weight.

A toner 6 with a weight average particle size of 6.8 μm was produced in the same manner as in Example 1 and evaluated. Properties and evaluation results of the toner 6 are shown in Tables 3 to 6. The toner exhibited nearly good storage stability, but had inferior low-temperature fixing properties. Moreover, the termination temperature on the high temperature side of fixing properties was lowered. Further, the image density was reduced in an image after 5,000 sheet-endurance, and the charge quantity of the toner was reduced as compared with the initial period.

Comparative Example 3

Toner particles were obtained in the same manner as in Example 4, except for using the ester wax 4 instead of the ester wax 3 and adding the polymerization initiator in an amount of 0.8 part by weight.

A toner 7 with a weight average particle size of 6.5 μm was produced in the same manner as in Example 1 and evaluated. Properties and evaluation results of the toner 7 are shown in Tables 3 to 6. Although the toner exhibited good storage stability and low-temperature fixing properties, winding of a sheet of receiver paper occurred at 185° C. Further, the image density was reduced in an image after 5,000 sheet-endurance, and the charge quantity of the toner was reduced as compared with the initial period.

Comparative Example 4

Toner particles were obtained in the same manner as in Example 1, except for using the ester wax 4 instead of the ester wax 1, adding the polymerization initiator in an amount of 7 parts by weight, and setting the cooling rate after the polymerization at 10.00° C./min.

A toner 8 with a weight average particle size of 6.0 μm was produced in the same manner as in Example 1 and evaluated. Properties and evaluation results of the toner 8 are shown in Tables 3 to 6. Although low-temperature fixing properties were good, maximum gloss was exhibited at 195° C., and too much an amount of the toner seeped into a sheet of paper at a temperature above 195° C., whereby the image quality was reduced. Further, the image density was just a little small at the initial period, but was obviously reduced in an image after 5,000 sheet-endurance, and the charge quantity of the toner was significantly reduced as compared with the initial period. In addition, the toner exhibited inferior storage stability.

Comparative Example 5

Toner particles were obtained in the same manner as in Example 4, except for using the ester wax 4 instead of the ester wax 3, adding the polymerization initiator in an amount of 7 parts by weight, and setting the cooling rate after the polymerization at 10.00° C./min.

A toner 9 with a weight average particle size of 6.4 μm was produced in the same manner as in Example 1 and evaluated. Properties and evaluation results of the toner 9 are shown in Tables 3 to 6. Although the toner exhibited good low-temperature fixing properties, winding of a sheet of receiver paper occurred at 185° C. Further, the image density was just a little small at the initial period, but was obviously reduced in an image after 5,000 sheet-endurance, and the charge quantity of the toner was significantly reduced as compared with the initial period. In addition, the toner exhibited inferior storage stability.

Comparative Example 6

Toner particles were obtained in the same manner as in Example 4, except for using the ester wax 5 instead of the ester wax 3, adding the polymerization initiator in an amount of 0.8 part by weight, and setting the cooling rate after the polymerization at 10.00° C./min.

A toner 10 with a weight average particle size of 6.6 μm was produced in the same manner as in Example 1 and evaluated. Properties and evaluation results of the toner 10 are shown in Tables 3 to 6. The toner exhibited nearly good storage stability, but had obviously inferior low-temperature fixing properties. Moreover, the termination temperature on the high temperature side of fixing properties was lowered. Further, the image density was reduced in an image after 5,000 sheet-endurance, and the charge quantity of the toner was reduced as compared with the initial period.

Example 5

Toner particles were obtained in the same manner as in Example 1, except for setting the cooling rate after the polymerization at 0.10° C./min.

A toner 11 with a weight average particle size of 6.3 μm was produced in the same manner as in Example 1 and evaluated. Properties and evaluation results of the toner 11 are shown in Tables 3 to 6.

Example 6

Toner particles were obtained in the same manner as in Example 3, except for adding the polymerization initiator in an amount of 3.5 parts by weight.

A toner 12 with a weight average particle size of 6.4 μm was produced in the same manner as in Example 3 and evaluated. Properties and evaluation results of the toner 12 are shown in Tables 3 to 6.

Example 7

Toner particles were obtained in the same manner as in Example 3, except for adding the polymerization initiator in an amount of 4.5 parts by weight.

A toner 13 with a weight average particle size of 6.4 μm was produced in the same manner as in Example 3 and evaluated. Properties and evaluation results of the toner 13 are shown in Tables 3 to 6.

This application claims a priority from Japanese Patent Application No. 2003-406968 filed on Dec. 5, 2003, of which the disclosure is incorporated herein by reference as a part of this application.

TABLE 3

| Ex. | Toner No. | Ester wax No. | Polymethylene wax No. | Cooling rate (° C./min) | Weight average particle size (μm) | Number average particle size (μm) | Variation coefficient | Circularity |
|---|---|---|---|---|---|---|---|---|
| Ex. 1 | 1 | 1 | 1 | 0.40 | 6.3 | 5.2 | 0.15 | 0.978 |
| Ex. 2 | 2 | 2 | 2 | 0.40 | 6.5 | 5.4 | 0.16 | 0.977 |
| Ex. 3 | 3 | 3 | 3 | 0.40 | 6.4 | 5.3 | 0.19 | 0.975 |
| Ex. 4 | 4 | 3 | — | 0.40 | 6.3 | 5.3 | 0.18 | 0.971 |
| Com. Ex. 1 | 5 | 4 | 1 | 0.40 | 5.9 | 4.5 | 0.22 | 0.970 |
| Com. Ex. 2 | 6 | 5 | — | 0.40 | 6.8 | 4.9 | 0.23 | 0.971 |
| Com. Ex. 3 | 7 | 4 | — | 0.40 | 6.5 | 4.4 | 0.28 | 0.970 |
| Com. Ex. 4 | 8 | 4 | 1 | 10.00 | 6.0 | 4.7 | 0.23 | 0.967 |
| Com. Ex. 5 | 9 | 4 | — | 10.00 | 6.4 | 5.2 | 0.24 | 0.968 |
| Com. Ex. 6 | 10 | 5 | — | 10.00 | 6.6 | 4.7 | 0.27 | 0.966 |
| Ex. 5 | 11 | 1 | 1 | 0.10 | 6.3 | 5.2 | 0.14 | 0.985 |
| Ex. 6 | 12 | 3 | 3 | 0.40 | 6.4 | 5.1 | 0.21 | 0.972 |
| Ex. 7 | 13 | 3 | 3 | 0.40 | 6.3 | 5.0 | 0.22 | 0.970 |

| Ex. | Peak of molecular weight distribution | Weight average molecular weight (Mw) | Number average molecular weight (Mn) | Mw/Mn | Content of THF-insoluble matter (wt. %) | Wax shape | Wax dispersion state |
|---|---|---|---|---|---|---|---|
| Ex. 1 | 21800 | 198000 | 23200 | 8.5 | 27.8 | (c) Needle-like | (b) Multicentric |
| Ex. 2 | 21500 | 197000 | 22900 | 8.6 | 27.9 | (c) Needle-like | (b) Multicentric |
| Ex. 3 | 21700 | 204000 | 23100 | 8.8 | 27.6 | (b) Rod-like | (a) Monocentric |
| Ex. 4 | 21200 | 201000 | 22800 | 8.8 | 26.9 | (a) Globular | (b) Multicentric |
| Com. Ex. 1 | 12800 | 169000 | 15300 | 11.0 | 27.7 | (c) Needle-like | (b) Multicentric |
| Com. Ex. 2 | 13500 | 172000 | 15600 | 11.0 | 28.1 | (a) Globular | (a) Monocentric |
| Com. Ex. 3 | 76800 | 489000 | 108700 | 4.5 | 30.4 | (a) Globular | (a) Monocentric |
| Com. Ex. 4 | 12900 | 169000 | 15400 | 11.0 | 27.7 | (c) Needle-like | (b) Multicentric |

TABLE 3-continued

| | | | | | | | |
|---|---|---|---|---|---|---|---|
| Com. Ex. 5 | 13600 | 176000 | 15900 | 11.1 | 273 | (a) Globular | (a) Monocentric |
| Com. Ex. 6 | 77400 | 493000 | 110200 | 4.5 | 30.5 | (a) Globular | (a) Monocentric |
| Ex. 5 | 21800 | 198000 | 23300 | 8.5 | 27.7 | (c) Needle-like | (b) Multicentric |
| Ex. 6 | 18700 | 186000 | 21800 | 8.5 | 27.4 | (b) Rod-like | (a) Monocentric |
| Ex. 7 | 16400 | 181000 | 19300 | 9.4 | 27.3 | (b) Rod-like | (a) Monocentric |

TABLE 4

| Ex. | Tg1 (° C.) | Tg2 (° C.) | Tg1 − Tg2 (° C.) | Content of resin component of a molecular weight of 2,000 to 5,000 (wt. %) | Endothermic peak observed in first scan (° C.) | Endothermic peak observed in second scan (° C.) | Q1 (J/g) | Q2 (J/g) | Q1/Q2 | Q3 (J/g) | Q4 (J/g) | Q3/Q4 |
|---|---|---|---|---|---|---|---|---|---|---|---|---|
| Ex. 1 | 56.7 | 46.1 | 10.6 | 3.2 | 59.6/87.3 | 87.4 | 10.7 | 1.3 | 8.23 | 6.8 | 6.6 | 1.03 |
| Ex. 2 | 59.2 | 49.7 | 9.5 | 3.2 | 68.8/98.5 | 68.9/98.4 | 9.3 | 3.2 | 2.91 | 7.3 | 6.8 | 1.07 |
| Ex. 3 | 58.3 | 50.2 | 8.1 | 3.1 | 63.8/73.9 | 63.9/73.6 | 16.3 | 6.2 | 2.63 | 5.6 | 5.2 | 1.08 |
| Ex. 4 | 56.8 | 50.4 | 6.4 | 3.3 | 63.6 | 63.3 | 18.2 | 8.9 | 2.04 | — | — | — |
| Com. Ex. 1 | 52.1 | 49.4 | 2.7 | 42.8 | 54.2/88.1 | 54.5/88.3 | 3.8 | 2.1 | 1.81 | 6.9 | 6.6 | 1.05 |
| Com. Ex. 2 | 65.8 | 65.1 | 0.7 | 41.9 | 77.9 | 77.7 | 19.1 | 18.6 | 1.03 | — | — | — |
| Com. Ex. 3 | 65.7 | 44.6 | 21.1 | 0.7 | 54.9 | 55.0 | 19.4 | 1.8 | 10.78 | — | — | — |
| Com. Ex. 4 | 49.5 | 49.4 | 0.1 | 42.3 | 88.3 | 88.2 | 0.3 | 0.2 | 1.35 | 7.0 | 6.8 | 1.03 |
| Com. Ex. 5 | 49.6 | 49.3 | 0.3 | 0.8 | 55.1 | 55.2 | 7.8 | 7.9 | 0.99 | — | — | — |
| Com. Ex. 6 | 63.8 | 62.5 | 1.3 | 43.0 | 71.2 | 70.6 | 13.3 | 11.7 | 1.14 | — | — | — |
| Ex. 5 | 58.3 | 46.0 | 12.3 | 3.2 | 59.8/87.5 | 87.4 | 12.1 | 1.3 | 9.31 | 7.0 | 6.6 | 1.06 |
| Ex. 6 | 56.2 | 50.3 | 5.9 | 12.1 | 63.1/73.6 | 63.2/73.5 | 13.8 | 6.1 | 2.26 | 5.5 | 5.1 | 1.08 |
| Ex. 7 | 54.8 | 50.2 | 4.6 | 22.7 | 62.9/73.3 | 63.0/73.4 | 12.1 | 6.0 | 2.02 | 5.4 | 5.0 | 1.08 |

TABLE 5

| Ex. | Tf1 (° C.) | Tf2 (° C.) | Tff1 (° C.) | Hf1 (mm) | Tff2 (° C.) | Hf2 (mm) | Tfr |
|---|---|---|---|---|---|---|---|
| Ex. 1 | 50.2 | 61.1 | 54.6 | 0.06 | 59.4 | 2.00 | 0.40 |
| Ex. 2 | 52.6 | 63.2 | 56.3 | 0.06 | 61.3 | 2.01 | 0.39 |
| Ex. 3 | 51.7 | 63.4 | 56.1 | 0.05 | 61.4 | 1.99 | 0.37 |
| Ex. 4 | 48.8 | 61.3 | 54.0 | 0.07 | 59.5 | 2.01 | 0.35 |
| Com. Ex. 1 | 47.1 | 54.2 | 51.1 | 0.06 | 53.6 | 2.00 | 0.78 |
| Com. Ex. 2 | 47.7 | 67.3 | 63.9 | 0.07 | 66.6 | 2.02 | 0.72 |
| Com. Ex. 3 | 49.0 | 68.8 | 55.4 | 0.05 | 67.1 | 1.99 | 0.17 |
| Com. Ex. 4 | 44.3 | 61.6 | 46.7 | 0.06 | 59.0 | 2.00 | 0.16 |
| Com. Ex. 5 | 43.5 | 51.7 | 48.8 | 0.06 | 51.2 | 2.00 | 0.81 |
| Com. Ex. 6 | 55.4 | 65.9 | 62.4 | 0.06 | 65.1 | 2.01 | 0.72 |
| Ex. 5 | 51.3 | 61.0 | 55.4 | 0.05 | 59.4 | 1.99 | 0.49 |
| Ex. 6 | 49.8 | 63.4 | 55.7 | 0.06 | 61.4 | 2.00 | 0.34 |
| Ex. 7 | 48.6 | 64.1 | 53.2 | 0.06 | 59.3 | 2.00 | 0.32 |

TABLE 6

| Ex. | Offset resistance: Initiation temperature on the low temperature side (° C.) | Offset resistance: Termination temperature on the high temperature side (° C.) | Low-temperature fixing properties: Initial fixing temperature (° C.) | Low-temperature fixing properties: Final fixing temperature (° C.) | Storage stability | Initial period: Image density | Initial period: Charge quantity (mC/kg) | After 5,000 sheet-endurance: Image density | After 5,000 sheet-endurance: Charge quantity (mC/kg) |
|---|---|---|---|---|---|---|---|---|---|
| Ex. 1 | 130 | 230 | 130 | 230 | A | 1.53 | 34.7 | 1.48 | 34.2 |
| Ex. 2 | 135 | 230 | 135 | 230 | A | 1.52 | 34.1 | 1.49 | 33.8 |
| Ex. 3 | 130 | 230 | 135 | 230 | A | 1.53 | 33.2 | 1.50 | 33.3 |
| Ex. 4 | 135 | 230 | 135 | 220 | A | 1.54 | 32.8 | 1.46 | 31.9 |
| Com. Ex. 1 | 130 | 220 | 135 | 195 | C | 1.49 | 34.8 | 1.37 | 29.2 |
| Com. Ex. 2 | 150 | 230 | 150 | 210 | B | 1.48 | 33.6 | 1.38 | 29.1 |
| Com. Ex. 3 | 130 | 185 | 135 | 185 | A | 1.47 | 31.7 | 1.28 | 22.3 |
| Com. Ex. 4 | 130 | 220 | 135 | 195 | D | 1.41 | 29.3 | 1.19 | 19.3 |
| Com. Ex. 5 | 130 | 185 | 135 | 185 | D | 1.38 | 28.6 | 1.14 | 18.8 |
| Com. Ex. 6 | 155 | 230 | 160 | 220 | A | 1.51 | 33.1 | 1.39 | 28.7 |
| Ex. 5 | 130 | 230 | 130 | 230 | A | 1.56 | 34.6 | 1.54 | 34.4 |
| Ex. 6 | 130 | 230 | 135 | 220 | A | 1.53 | 33.1 | 1.47 | 32.3 |
| Ex. 7 | 130 | 220 | 130 | 210 | A | 1.50 | 32.7 | 1.42 | 30.6 |

What is claimed is:

1. A toner comprising: toner particles, each said toner particle comprising a binder resin and a crystalline ester wax having, in a DSC curve obtained by measuring the toner with a differential scanning calorimeter, a glass transition temperature (Tg1) measured in a first scan of 50.0 to 70.0° C. and a temperature difference (Tg1–Tg2) of 3.0 to 20.0° C. between the glass transition temperature (Tg1) measured in the first scan and a glass transition temperature (Tg2) measured in a second scan, wherein said Tg1 and Tg2 are measured by conducting, in sequence, the following steps (i) to (iv):

(i) maintaining the toner at 10° C. for one minute, (ii) measuring Tg1 of the maintained toner with the differential scanning calorimeter by a mid-point method in the first scan from 10° C. to 160° C. at a rate of temperature rise of 1° C./minute, (iii) cooling the measured toner in the first scan, from 160° C. to 10° C. at a cooling rate of 2° C./minute and maintaining the cooled toner at 10° C. for 10 minutes, and (iv) measuring the Tg2 of the cooled toner with the differential scanning calorimeter by a midpoint method on the second scan from 10° C. to 160° C. at a rate of temperature rise of 1° C./minute; and wherein the toner comprises a resin component of a molecular weight of 2,000 to 5,000 in an amount of 1.5 to 20.0% by weight based on the total weight of the toner.

2. The toner according to claim 1, wherein the glass transition temperature (Tg2) measured in a second scan is 45.0 to 55.0° C.

3. The toner according to claim 1, wherein the toner has a melting point (Tm1) of 55.0 to 70.0° C. in a DSC curve of the toner measured in a first scan.

4. The toner according to claim 3, wherein the toner has a ratio (Q1/Q2) of an endothermic quantity Q1 measured in a first scan to an endothermic quantity Q2 measured in a second scan ranging from 2.00 to 50.00 in a melting peak having the melting point (Tm1).

5. The toner according to claim 1, wherein the crystalline ester wax comprises a $C_{18}$ to $C_{42}$ ester compound.

6. The toner according to claim 1, wherein the crystalline ester wax comprises a fatty acid ester compound having a $C_{10}$ to $C_{21}$ alkyl group.

7. The toner according to claim 5 or 6, wherein the crystalline ester wax comprises two or more ester compounds, and comprises an ester compound having an identical structure among the ester compounds in an amount of 50 to 95% by weight based on the total weight of the ester wax.

8. The toner according to claim 5 or 6, wherein the toner further comprises a polymethylene wax.

9. The toner according to claim 1, wherein the toner has a melting point (Tm2) of 71.0 to 150.0° C. in a DSC curve of the toner measured in a second scan.

10. The toner according to claim 9, wherein the toner has a ratio (Q3/Q4) of an endothermic quantity Q3 measured in a first scan to an endothermic quantity Q4 measured in a second scan ranging from 0.80 to 1.20 in a melting peak having the melting point (Tm2).

11. The toner according to claim 10, wherein the endothermic quantity Q4 measured in a second scan is from 1.5 to 20.0 J/g.

12. The toner according to claim 9, wherein the wax component causing the melting point (Tm2) is a polymethylene wax.

13. The toner according to claim 1, wherein the toner comprises a tetrahydrofuran-insoluble matter in an amount of 5 to 90% by weight based on the total weight of the toner.

14. The toner according to claim 1, wherein the toner comprises a tetrahydrofuran-soluble matter with a number average molecular weight (Mn) of 3,000 to 100,000, a weight average molecular weight (Mw) of 10,000 to 1,000,000, and a ratio of Mw to Mn (Mw/Mn) of 2.00 to 100.00.

15. The toner according to claim 1, wherein the toner has a transformation initiation temperature (Tf1) of 45.0 to 60.0° C., and a transformation coefficient (Tfr) of 0.3 to 0.7.

* * * * *